US009285727B2

(12) United States Patent
Takematsu et al.

(10) Patent No.: US 9,285,727 B2
(45) Date of Patent: Mar. 15, 2016

(54) SHEET CONVEYING APPARATUS AND IMAGE FORMING APPARATUS

(71) Applicant: CANON KABUSHIKI KAISHA, Tokyo (JP)

(72) Inventors: Koji Takematsu, Abiko (JP); Kazuhisa Okuda, Tokyo (JP); Kenjiro Sugaya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/695,277

(22) Filed: Apr. 24, 2015

(65) Prior Publication Data

US 2015/0316876 A1 Nov. 5, 2015

(30) Foreign Application Priority Data

Apr. 30, 2014 (JP) ..... 2014-093705
Mar. 10, 2015 (JP) ..... 2015-047165

(51) Int. Cl.

| | |
|---|---|
| ***G03G 15/20*** | (2006.01) |
| ***B65H 7/20*** | (2006.01) |
| ***B65H 5/06*** | (2006.01) |
| ***B65H 5/26*** | (2006.01) |

(52) U.S. Cl.

CPC ..... *G03G 15/2028* (2013.01); *B65H 5/068* (2013.01); *B65H 5/26* (2013.01); *B65H 7/20* (2013.01)

(58) Field of Classification Search

None

See application file for complete search history.

(56) References Cited

U.S. PATENT DOCUMENTS

| | | | | |
|---|---|---|---|---|
| 5,669,039 | A | 9/1997 | Ohtsuka et al. | |
| 7,424,261 | B2 | 9/2008 | Uchida et al. | |
| 7,684,745 | B2 | 3/2010 | Uchida et al. | |
| 2007/0253729 | A1 * | 11/2007 | Takagi | 399/117 |
| 2014/0205317 | A1 | 7/2014 | Takematsu et al. | |
| 2015/0115527 | A1 | 4/2015 | Takematsu et al. | |

FOREIGN PATENT DOCUMENTS

| | | | |
|---|---|---|---|
| JP | 05-150679 | A | 6/1993 |
| JP | 3084692 | B2 | 9/2000 |

OTHER PUBLICATIONS

U.S. Appl. No. 14/606,231 to Kenjiro Sugaya et al., filed Jan. 27, 2015, Unpublished.
U.S. Appl. No. 14/695,284 to Kazuhisa Okuda et al., filed Apr. 24, 2015, Unpublished.

* cited by examiner

*Primary Examiner* — Clayton E LaBalle
*Assistant Examiner* — Jas Sanghera
(74) *Attorney, Agent, or Firm* — Fitzpatrick, Cella, Harper & Scinto

(57) ABSTRACT

A sheet conveying apparatus includes a first pair of rotating members; a second pair of rotating members which is provided in a downstream side of the first pair of rotating members in a conveying direction of a sheet; and a load portion which applies a load on a rotation of the first pair of rotating members to generate a tensile stress in the sheet; wherein the load portion includes, a slidably moving member arranged on both sides in an axial direction of a rotary member, a fixing member arranged to nip the slidably moving member on both sides in the axial direction of the rotary member from both outer sides in the axial direction, the fixing member being arranged to be movable in the axial direction and being rotation regulated, and a force applying portion which applies force on the fixing member in the axial direction of the rotary member.

28 Claims, 19 Drawing Sheets

FIG. 10A

VALUES AFTER PASSING FIXING DEVICE 100

| | INITIAL | AFTER DISCHARGE | STRETCH AMOUNT |
|---|---|---|---|
| END LENGTH L edge[mm] | 420.4 | 421.0 | 0.6 |
| CENTER LENGTH L center[mm] | 420.4 | 420.4 | 0 |
| MAXIMUM CORRUGATION AMOUNT X max[mm] | 0.4 | 3.3 | - |

FIG. 10B

VALUES AFTER PASSING FIRST SHEET PULLING CONVEYING APPARATUS101, SECOND SHEET PULLING CONVEYING APPARATUS 201, AND THIRD SHEET PULLING CONVEYING APPARATUS 301 AFTER PASSING FIXING DEVICE 100

| | INITIAL | AFTER DISCHARGE | STRETCH AMOUNT |
|---|---|---|---|
| END LENGTH L edge[mm] | 420.4 | 421.0 | 0.6 |
| CENTER LENGTH L center[mm] | 420.4 | 421.0 | 0.6 |
| MAXIMUM CORRUGATION AMOUNT X max[mm] | 0.4 | 1.0 | - |

SHEET CONVEYING APPARATUS AND IMAGE FORMING APPARATUS

BACKGROUND OF THE INVENTION

1. Field of the Invention

The present invention relates to a sheet conveying apparatus used in an image forming apparatus such as a copying machine, a printer, and a facsimile including a torque applying device that applies a predetermined torque on a rotary member and that adopts a method of fixing a non-fixed toner image by heating and pressuring, and an image forming apparatus such as the copying machine, the printer, and the facsimile equipped with the sheet conveying apparatus.

2. Description of the Related Art

Conventionally, an image forming apparatus using an electrophotographic system develops a latent image formed on a photosensitive drum serving as an image bearing member to obtain a visible image, and transfers the visible image (toner image) on a sheet using an electrostatic force. The toner image on the sheet is then fixed by heat to record and form the image on the sheet.

For such fixing device of the image forming apparatus, a heat roller fixing method of pressing a pressure roller having an elasticity against a fixing roller, which interiorly includes a heat source such as a heater to be maintained at a predetermined temperature, to form a fixing nip portion, and fixing the toner image on the sheet at the fixing nip portion is adopted.

Recently in the image forming apparatus (in particular, full color image forming apparatus) using this type of fixing device, a fixing device that can stretch the heating time and that can increase the fixing speed is known from the standpoint of enhancing the color emitting property and the image equality of the toner image. For example, as described in Japanese Patent Laid-Open No. 5-150679, a fixing device of a so-called belt nip method that presses an endless fixing belt bridged across a plurality of rollers against a heating roll is known.

Furthermore, higher speed is also necessary in the process speed in recent years to increase the speed of the output of the image forming apparatus. To this end, a wider nip width is required in a width direction orthogonal to a conveying direction of a sheet, and a belt fixing method that replaces the fixing roller or the pressure roller, or both rollers with an endless belt to ensure a wide nip width has been proposed and put into production (Japanese Patent Laid-Open No. 5-150679).

However, in a heat-fixing step of such fixing devices, heat and pressure are applied on the sheet, on which the toner image is transferred, and hence moisture evaporates from inside the sheet after the press nip portion and the press-nip. The change in the amount of moisture caused by the heat of the sheet and the stress caused by the pressure applied on the sheet that occurs at the time cause a phenomenon referred to as a curl, in which the sheet curls, or a phenomenon referred to as corrugation, in which the sheet becomes an undulated shape.

A sheet-like paper most typically used for the sheet is viewed in fiber level. The fibers are entangled to configure a paper, and moisture is contained inside the fiber or between the fibers. Furthermore, since the fiber and water are hydrogen bonded and are in an equilibrium state, smoothness is maintained.

However, if heat and pressure are applied on the sheet in the fixing step, shift occurs between the fibers by the pressure, and if heat is applied in such a state thus causing the moisture to evaporate, further hydrogen bonding occurs between the fibers thus leading to deformation. If such sheet is left untouched, the sheet absorbs moisture from the environment, whereby the hydrogen bonding between the fibers is again separated to return to the original state. However, the moisture does not go between the fibers at one part of the sheet, whereby the deformation of the sheet is maintained. The pattern of deformation includes the curl and the corrugation mentioned above, where the curl occurs due to the stretching/contracting difference of the front and the back of the sheet, and the corrugation occurs due to the stretching/contracting difference of the central part and the end of the sheet.

A first factor the corrugation occurs at the end of the sheet lies in a course in which the sheet is passed through the nip portion of the fixing device. For example, in the case of the fixing device including a wide nip as in the belt fixing method, a conveying velocity at the end side is set to be higher than at the central part in the width direction orthogonal to the conveying direction of the sheet in the nip to prevent wrinkles of the sheet in the course the sheet is passed through the nip portion. Thus, the end of the sheet stretches in the conveying direction than the vicinity of the middle after passing the nip portion when applying a rubbing action on the sheet, and the corrugation occurs at the end of the sheet.

A second factor the corrugation occurs at the end of the sheet lies in after the sheet is passed through the nip portion of the fixing device. In a state mounted as a sheet bundle, the respective sheets are brought into contact with the atmosphere at the end, and thus entering and exiting of the moisture rapidly occur. If the heat is applied on the sheet in the fixing step thus evaporating the moisture inside the sheet, and then the moisture is rapidly absorbed from the end of the sheet, the end of the sheet stretches in the conveying direction than the vicinity of the middle, as expected, and the corrugation occurs at the end of the sheet.

In particular, in the belt fixing method in which the fixing roller or the pressure roller, or both rollers are replaced with the endless belt to ensure the wide nip width, the distance and the time the sheet resides between the nips are increased compared to the heat roller method, whereby the problem of corrugation at the end of the sheet becomes significant.

According to the review from the inventors of the present application, it was found that the corrugation of the sheet can be corrected by pulling (applying tension to) the central part in the width direction of the sheet. In a more specific configuration, it was found that the corrugation of the sheet can be corrected by applying a load torque on the rotation of a pair of rollers on the upstream side when conveying the sheet by the pair of rollers on the upstream side and a pair of rollers on a downstream side.

Generally, when applying the load torque on the rotation of the roller (rotary member), a powder seal member, a bearing, and the like, which are configuring components, of a powder brake, for example, become high temperature during the high-rotation continuous use. The torque then may rapidly increase, the durability may degrade, or breakage may occur in the powder brake, and the like. Thus, a usage temperature limit (lower than or equal to 80° C.) is given to the powder brake, and the powder brake needs to be used at the torque and the rotation number that do not exceed the usage temperature limit.

SUMMARY OF THE INVENTION

It is desirable to provide a sheet conveying apparatus including a torque applying device that can be used even under conditions of high speed rotation and high torque, and an image forming apparatus.

In order to achieve the above object, a sheet conveying apparatus according to the present invention includes a first pair of rotating members which conveys a sheet; a second pair of rotating members which is provided in a downstream side of the first pair of rotating members in a conveying direction of a sheet and which conveys a sheet; and a load portion which capable of applying a load to rotation of the first pair of rotating members so as to generate a tensile stress onto the sheet when the sheet is nipped by the first pair of rotating members and the second pair of rotating members; wherein the load portion includes a rotary member, a slidably moving member arranged on both sides in an axial direction of the rotary member, a fixing member arranged to nip the slidably moving member on both sides in the axial direction of the rotary member from both outer sides in the axial direction, the fixing member being arranged to be movable in the axial direction and being rotation regulated, and a force applying portion which applies force on the fixing member in the axial direction of the rotary member.

According to the present invention, the torque can be applied to the rotary member even under the conditions of high speed rotation and high torque. The present invention is particularly effective in the sheet conveying apparatus that corrects the corrugation of the sheet by applying tension to the sheet.

Further features of the present invention will become apparent from the following description of exemplary embodiments with reference to the attached drawings.

BRIEF DESCRIPTION OF THE DRAWINGS

FIGS. 10A and 10B are tables illustrating the state of the sheet by experiments.

DESCRIPTION OF THE EMBODIMENTS

Hereinafter, suitable embodiments of the present invention will be illustratively described in detail with reference to the drawings. The dimension, material, shape, relative arrangements, and the like of the configuring components described in the following embodiments are to be appropriately changed according to the configuration of the device to which the present invention is applied and the various conditions. Therefore, unless a specific description is particularly made, the scope of the invention is not to be limited thereto.

First Example

An image forming apparatus including a sheet conveying apparatus according to a first example will be described using FIGS. 1 to 5. In the following description, the image forming apparatus will be described first, and then the sheet conveying apparatus will be described. In the present example, an image forming system in which the sheet conveying apparatus is connected to an exterior of the image forming apparatus will be described, but the present invention is effective even with a configuration of the image forming system in which the sheet conveying apparatus is integrally incorporated in the interior of the image forming apparatus.

Figure 2:
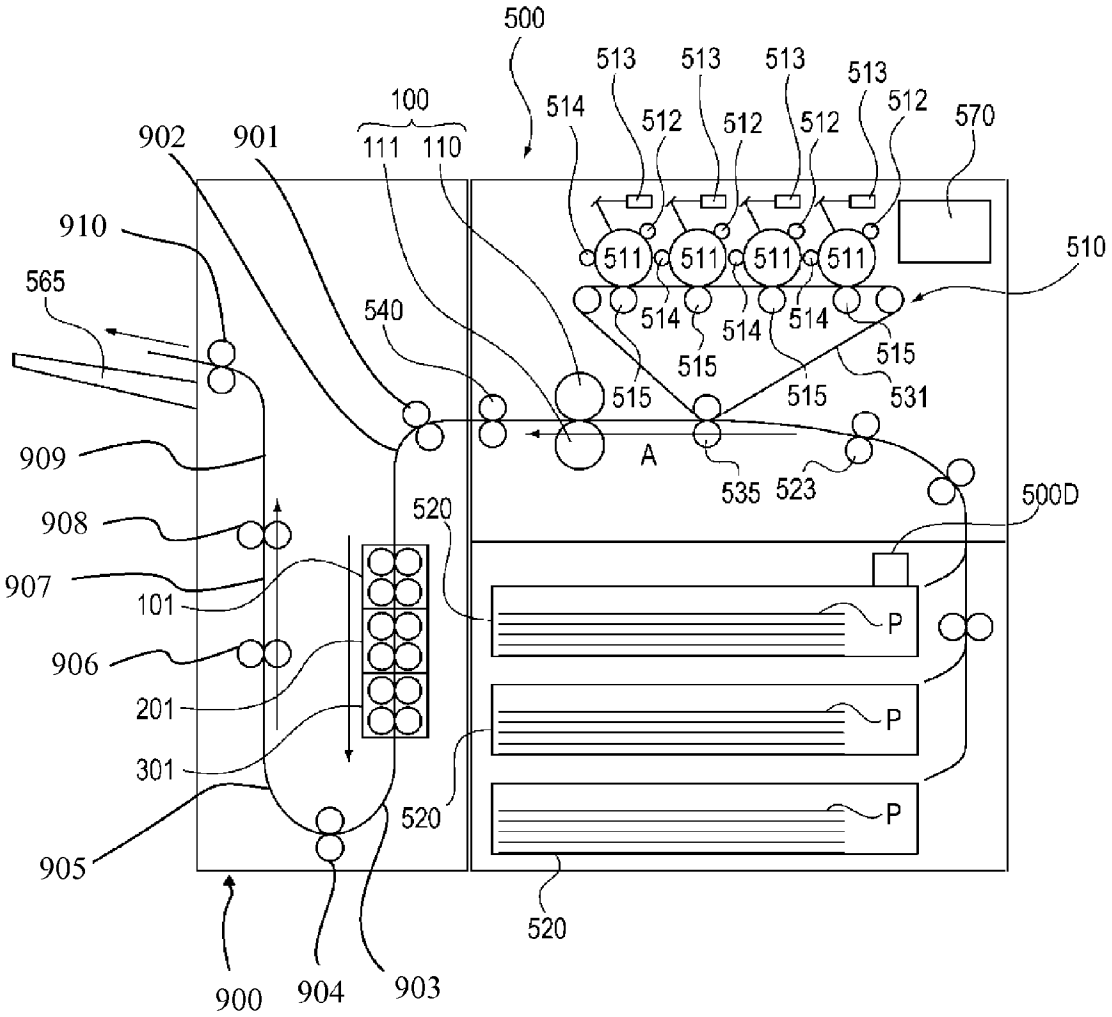
FIG. 2 is a cross-sectional view illustrating an electrophotographic printer of the first example.

First, the image forming apparatus and the sheet conveying apparatus detachably connected to the image forming apparatus will be described as an example of the image forming system using FIG. 2. FIG. 2 is a cross-sectional view schematically illustrating a sheet corrugation correcting device 900 including a color electrophotographic printer 500 serving as the image forming apparatus and a tension applying device serving as the sheet conveying apparatus, and is a cross-sectional view taken along a conveying direction of the sheet. In the following description, the color electrophotographic printer is simply referred to as "printer".

The sheet is to be formed with a toner image. Specific examples of the sheet include a plain paper, sheet-like paper made of resin, which is substitute for the plain paper, cardboard, paper for overhead projector, and the like.

The printer 500 illustrated in FIG. 2 includes an image forming portion 510 of each color of Y (yellow), M (magenta), C (cyan), and Bk (black). The image forming portion 510 of each color forms the toner image of each color on the sheet. An endless intermediate transfer belt 531 serving as an intermediate transfer member is arranged to face the image forming portions. In other words, the image forming apparatus adopts a tandem method in which the processes until obtaining the visible image are parallel processed in each color.

An arrangement order of the image forming portions of each color of Y, M, C, and K is not limited to the arrangement order illustrated in FIG. 2. The image forming apparatus of the full color intermediate transfer method illustrated in FIG. 2 is not the sole case, and even a case of monochrome image forming apparatus can be adopted for the embodiment.

The image forming portion 510 of each color includes each process portion below. The image forming portion 510 includes an electrophotographic photosensitive member (hereinafter referred to as photosensitive drum) 511 serving as an image bearing member that bears an electrostatic latent image on a surface in correspondence with each color of Y, M, C, and K, a charging roller 512, a laser scanner 513, and a development device 514. The photosensitive drum 511 is charged in advance by the charging roller 512. Thereafter, the photosensitive drum 511 is exposed by the laser scanner 513 to form a latent image. The latent image is developed by the development device 514, and a visible image is obtained as a toner image.

Each toner image formed and borne on the surface of the photosensitive drum 511 is primary transferred, in a sequentially superimposed manner, onto the intermediate transfer belt 531 by a primary transfer roller 515 in a primary transfer portion of the photosensitive drum 511 and the primary transfer roller 515.

A sheet P is fed out one at a time from a sheet cassette 520 and fed into a pair of registration rollers 523. The pair of registration rollers 523 once receives the sheet P, and corrects the skew feeding if the sheet is being skew fed. The pair of registration rollers 523 feeds the sheet P to a secondary transfer portion between the intermediate transfer belt 531 and a secondary transfer roller 535 in synchronization with the toner image on the intermediate transfer belt 531. The color toner images on the intermediate transfer belt 531 are collectively secondary transferred onto the sheet P by the secondary transfer roller 535, for example, which is the transfer portion.

Subsequently, the sheet on which the image (toner image) is formed by the image forming portion in a manner described above is conveyed to a fixing device 100. In the fixing device (fixing portion) 100, heat and pressure are applied on a non-fixed toner image while nipping the sheet at a fixing nip portion to fix the toner image on the sheet. The sheet that passed the fixing device 100 is fed to the sheet corrugation correcting device 900 serving as a sheet processing apparatus that performs processes on the sheet by a pair of discharge rollers 540. The corrugation of the sheet is corrected by the sheet corrugation correcting device 900, and then the sheet is discharged to a discharge tray 565.

The fixing device will be described below. The fixing device 100 includes a fixing roller 110, which is a heating rotating member, and a pressure roller 111, which is a pressuring rotating member. The fixing roller 110 applies the heat generated by an interior halogen heater (not illustrated) to the toner on the sheet P and also conveys the sheet P with the pressure roller 111. The fixing roller 110 incorporates a halogen heater in a metal core including an aluminum cylindrical tube having an outer diameter of 56 mm and an inner diameter of 50 mm, for example. On a surface of the metal core is provided an elastic layer made from silicon rubber having a thickness of 2 mm and a hardness of (Aska C) 45°, and a PFA or PTFE heat resistant toner parting layer is further covered on a surface layer of the elastic layer.

The pressure roller 111 conveys the sheet P with the fixing roller 110. The pressure roller 111 also has a metal core including an aluminum cylindrical tube having an outer diameter of 56 mm and an inner diameter of 50 mm, for example. On a surface of the metal core is provided an elastic layer made from silicon rubber having a thickness of 2 mm and a hardness of (Aska C) 45°, and a PFA or PTFE heat resistant toner parting layer is further covered on a surface layer of the elastic layer.

The fixing roller 110 and the pressure roller 111 configure a fixing nip portion. In the experiments conducted by the inventors of the present invention, the sheet P was conveyed at a conveying velocity of about 300 mm/sec under the conditions of a set temperature of the surface layer of the fixing roller 110 of 180° C., a set temperature of the surface layer of the pressure roller 111 of 100° C., an environmental temperature of 23° C., and an environmental humidity of 50%. In the sheet P heated and pressured in the fixing nip portion, the fibers on the end side in the width direction orthogonal to the conveying direction of the sheet stretch greatly than the central side in the conveying direction, and consequently, an end corrugation (hereinafter referred to as corrugation) occurs.

The sheet P on which the toner image is fixed by the fixing device 100 is fed to the sheet corrugation correcting device 900 by the pair of discharge rollers 540. The sheet P is conveyed along a conveying guide 902 by a pair of inlet rollers 901 of the sheet corrugation correcting device 900. The sheet P changes the conveying direction toward a vertically lower side by the conveying guide 902, and is then fed to sheet pulling conveying apparatuses 101, 201, 301 in this order, serving as the tension applying device. The sheet P is sequentially passed through the sheet pulling conveying apparatuses 101, 201, 301, and the central part in the width direction orthogonal to the conveying direction of the sheet is pulled in the conveying direction to reduce the difference in length in the conveying direction of the sheet of the end and the middle in the width direction.

The sheet P in which the corrugation at the end in the width direction of the sheet is improved is thereafter conveyed by a pair of conveying rollers 904 while changing the conveying direction toward a vertically upper side by conveying guides 903, 905. The sheet P is then conveyed by pair of conveying rollers 906, 908 while being guided by conveying guides 907, 909, discharged to the outside of the sheet corrugation correcting device 900 by a pair of discharge rollers 910, and then mounted on the discharge tray 565.

Figure 3:
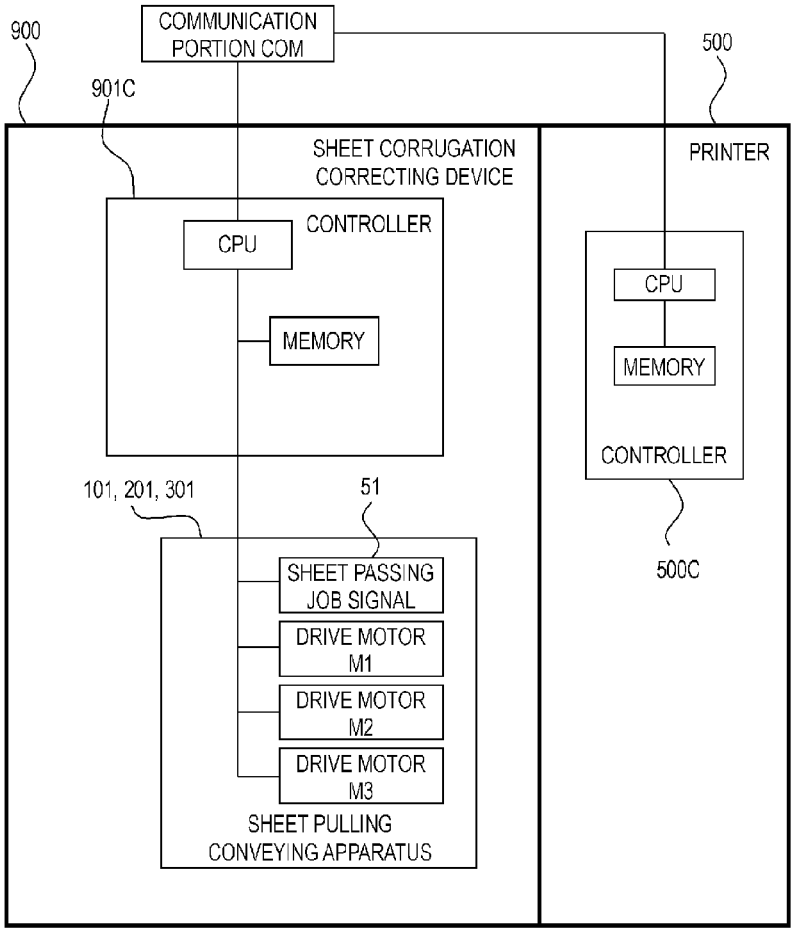
FIG. 3 is a block diagram illustrating a control relationship of the entire electrophotographic printer and the sheet corrugation correcting device.

A control relationship of the entire image forming system will now be described using FIG. 3. FIG. 3 is a block diagram illustrating the control relationship of the entire printer 500 and the sheet corrugation correcting device 900 configuring the image forming system. A controller 500C of the printer 500 and a controller 901C of the sheet corrugation correcting device 900 are respectively a computer system including a CPU, a memory, a computation portion, an I/O port, a communication interface, and a drive circuit.

The control by each controller 500C, 901C described above is carried out when each CPU executes a predetermined program stored in the memory. The controller 901C of the sheet corrugation correcting device 900 controls the operations of the sheet pulling conveying apparatuses 101, 201, 301 configuring the device. Furthermore, each controller 500C, 901C is connected by way of a communication portion COM to exchange information.

A configuration in which the controller 500C of the printer 500 controls the controller 901C of the sheet corrugation correcting device 900 to control the operation of the sheet corrugation correcting device 900 has been illustrated, but this is not the sole case. For example, the sheet corrugation correcting device may not include the controller, and the operation of the sheet corrugation correcting device may be controlled by the controller of the printer.

The configuration of a single body of each sheet pulling conveying apparatus (101, 201, 301) will now be described using FIGS. 1, 4, and 5. In the present example, the respective configurations of the first sheet pulling conveying apparatus 101, the second sheet pulling conveying apparatus 201, and the third sheet pulling conveying apparatus 301 are common. The first sheet pulling conveying apparatus 101, the second sheet pulling conveying apparatus 201, and the third sheet pulling conveying apparatus 301 include a plurality of pairs of rollers (pairs of rotating members) that apply a tension (tensile stress) for stretching the central part in the width direction of the sheet P in the conveying direction. Thus, the configuring components (reference numerals) will be simultaneously used for the description on the configuration of the sheet pulling conveying apparatus, to be described later.

The conveying velocity of the sheet by the pair of rollers (or rollers) described below means to the rotation velocity (linear velocity) of the pair of rollers (or rollers).

Figure 1:
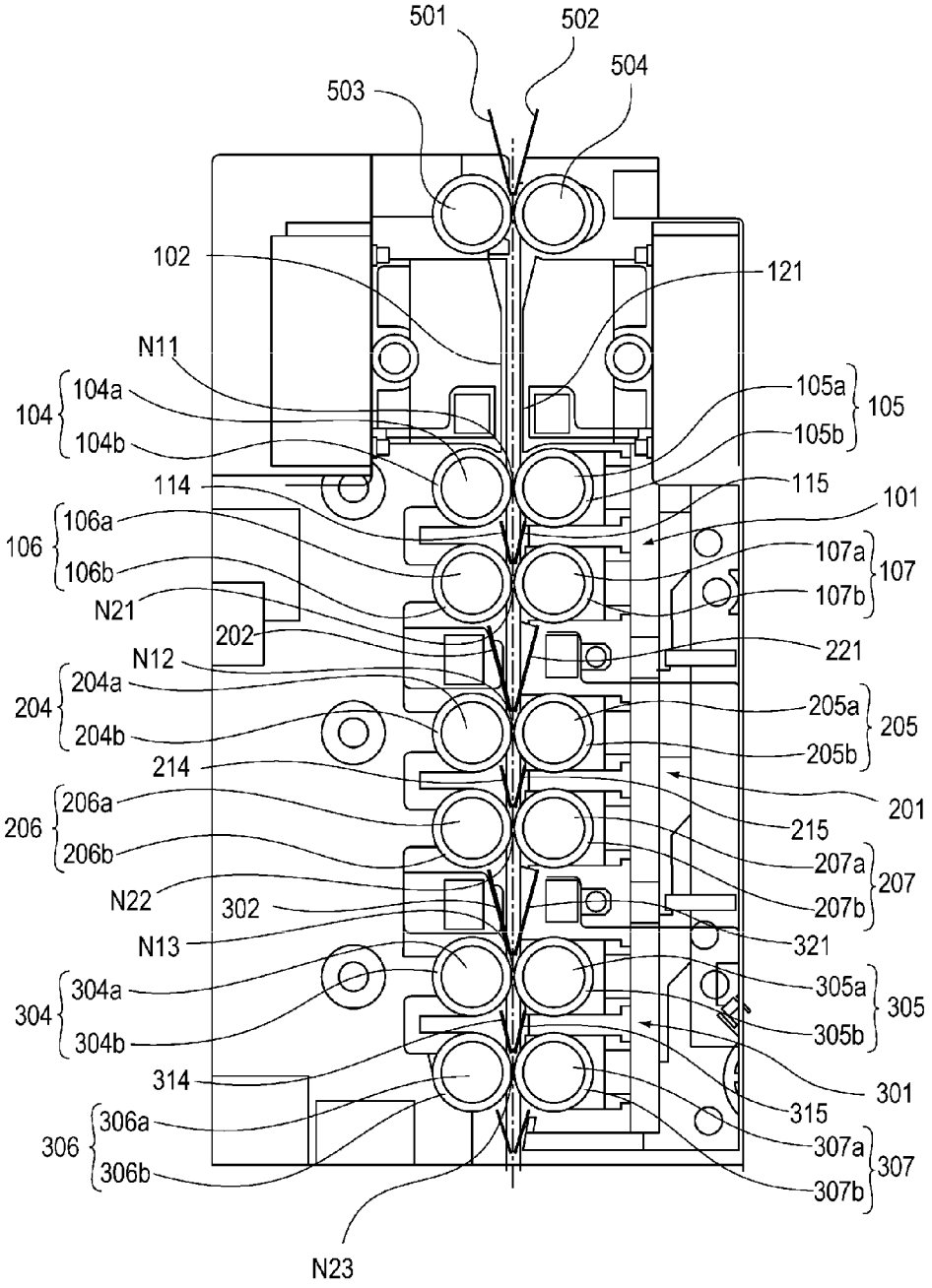
FIG. 1 is a cross-sectional view illustrating a pulling conveying apparatus of a first example.

FIG. 1 is a front cross-sectional view describing the sheet pulling conveying apparatuses 101, 201, 301 of the present example. FIG. 4 is a perspective view describing the sheet pulling conveying apparatuses 101, 201, 301 of the present example, and FIG. 5 is a left side view describing the sheet pulling conveying apparatuses 101, 201, 301 of the present example.

Each sheet pulling conveying apparatus includes a first pair of rollers (first pair of rotating members) and a second pair of rollers (second pair of rotating members) arranged on the downstream side of the conveying direction than the first pair of rollers, to be described below, for the plurality of pairs of rollers. The first pair of rollers and/or the second pair of rollers may be configured not with a roller but with a pair of belts.

The first pair of rollers includes a first drive roller, which is a rotatable first roller, and a first pressure roller, which is a second roller that is pressed by the first drive roller and forms a first nip portion to nip and convey the sheet.

The second pair of rollers is arranged on the downstream side in the conveying direction than the first pair of rollers. The second pair of rollers includes a second drive roller, which is a rotatable third roller, and a second pressure roller, which is a fourth roller that is pressed by the second drive roller and forms a second nip portion to nip and convey the sheet.

The first sheet pulling conveying apparatus 101 nips and conveys the sheet P with a first drive roller 104 and a first pressure roller 105, which configure the first pair of rollers, and a second drive roller 106 and a second pressure roller 107, which configure the second pair of rollers. The second sheet pulling conveying apparatus 201 nips and conveys the sheet P with a first drive roller 204 and a first pressure roller 205, which configure the first pair of rollers, and a second drive roller 206 and a second pressure roller 207, which configure the second pair of rollers. The third sheet pulling conveying apparatus 301 nips and conveys the sheet P with a first drive roller 304 and a first pressure roller 305, which configure the first pair of rollers, and a second drive roller 306 and a second pressure roller 307, which configure the second pair of rollers. Each sheet pulling conveying apparatus 101, 201, 301 applies a tension for stretching the central part in the width direction of the sheet P in the conveying direction to the sheet P while conveying the sheet P in order.

The first drive rollers 104, 204, 304, the first pressure rollers 105, 205, 305, the second drive rollers 106, 206, 306, and the second pressure rollers 107, 207, 307 each has an elastic rubber 104*b*, 105*b*, 106*b*, 107*b*, 204*b*, 205*b*, 206*b*, 207*b*, 304*b*, 305*b*, 306*b*, 307*b* such as silicon, NBR, EPDM, and the like formed on the surface layer of a roller shaft 104*a*, 105*a*, 106*a*, 107*a*, 204*a*, 205*a*, 206*a*, 207*a*, 304*a*, 305*a*, 306*a*, 307*a* using a high rigidity material such as stainless steel and iron and steel.

Figure 4:
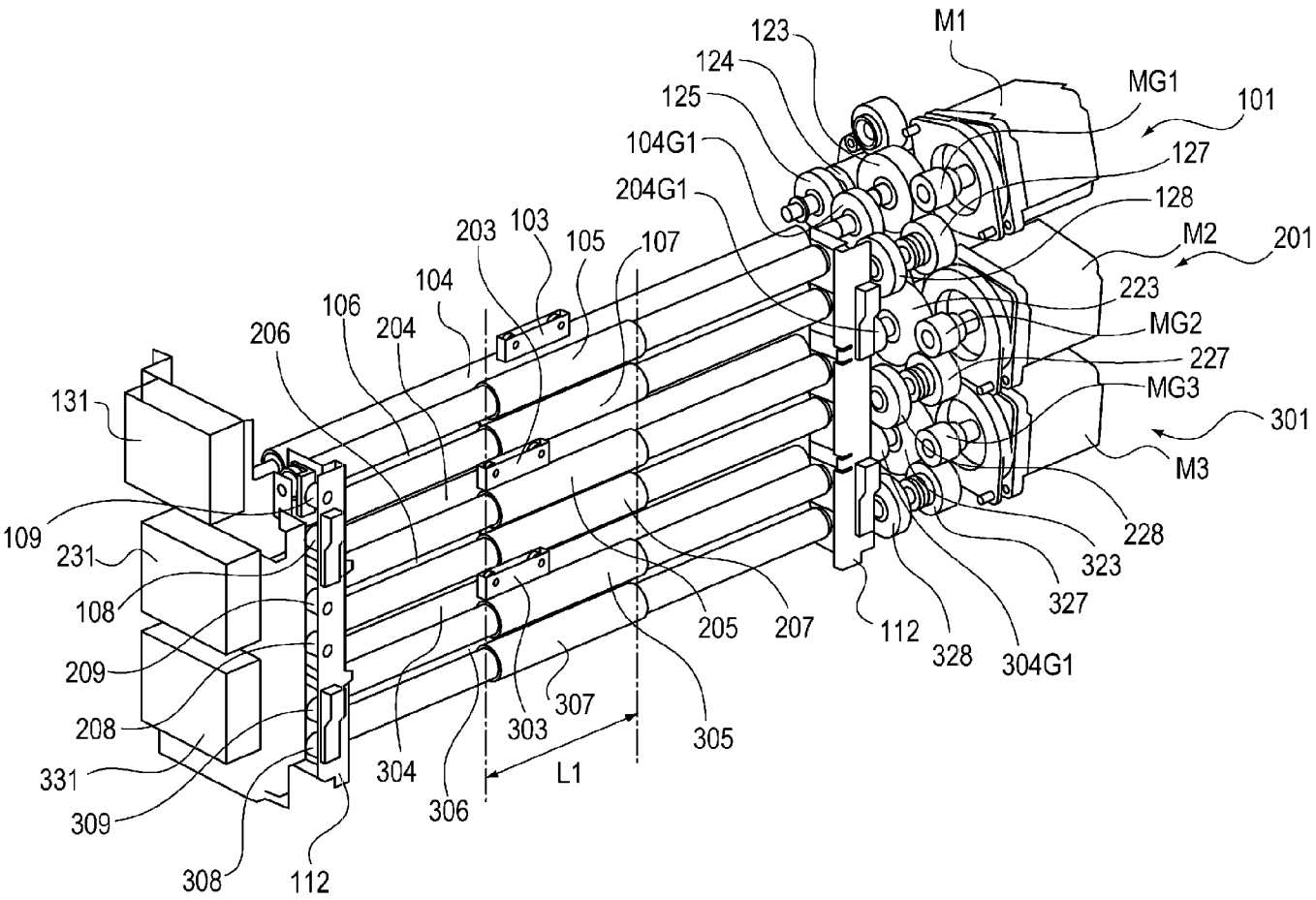
FIG. 4 is a perspective view illustrating a pulling conveying apparatus of the first example.

As illustrated in FIG. 4, the elastic rubbers 105*b*, 205*b*, 305*b* of the first pressure rollers 105, 205, 305 are formed in a region of a length L1 of the central part in the width direction of the sheet so as to become even with respect to the center of sheet passing (middle in the width direction). Similarly, the elastic rubbers 107*b*, 207*b*, 307*b* of the second pressure rollers 107, 207, 307 are formed in a region of the length L1 of the central part in the width direction of the sheet so as to become even with respect to the center of sheet passing (middle in the width direction). The center of sheet passing is a position of the middle in the width direction that becomes a reference when conveying the sheet. The length L1 is shorter than a sheet width (length in the width direction of a sheet of a predetermined size) of sheet P at which the corrugation illustrated in FIG. 9 becomes a problem. In the present example, L1 is set to L1=100 mm. The sheet of a predetermined size is a sheet of a size in which the frequency of being used in the device is high, and for example, is a sheet (297 mm) of A3 size. Thus, the elastic rubber 105*b*, 107*b*, 205*b*, 207*b*, 305*b*, 307*b* is arranged at the middle in the width direction. The first drive roller 104 and the first pressure roller 105 thus have a nip portion formed at the middle in the width direction. Similarly, the nip portion of the first drive roller 204 and the first pressure roller 205, and the nip portion of the first drive roller 304 and the first pressure roller 305 are also formed at the middle in the width direction. The second drive roller 106 and the second pressure roller 107 also have a nip portion formed at the middle in the width direction. Similarly, the nip portion of the second drive roller 206 and the second pressure roller 207, and the nip portion of the second drive roller 306 and the second pressure roller 307 are also formed at the middle in the width direction.

In the present example, the elastic rubber portion is arranged at the middle in the width direction of the first pressure rollers 105, 205, 305 and the second pressure rollers 107, 207, 307, but this is not the sole case. The elastic rubber portion may be arranged at the middle in the width direction of the first drive rollers 104, 204, 304 and the second drive rollers 106, 206, 306.

Conveying guides 114, 115, 214, 215, 314, 315, which are guide members for guiding the sheet, are arranged between the nip portions of the first pair of rollers and the second pair of rollers, where a distance between the nip portions is 25 mm.

The first drive rollers 104, 204, 304 and the second drive rollers 106, 206, 306 have both ends of the roller shafts 104*a*, 106*a*, 204*a*, 206*a*, 304*a*, 306*a* supported by way of a bearing (not illustrated) by upper side plates 119, 219, 319.

The first pressure rollers 105, 205, 305 have both ends of the roller shafts 105*a*, 205*a*, 305*a* supported by way of a bearing (not illustrated) by a pressure plate 112. The first pressure rollers 105, 205, 305 are applied with force by first pressuring springs 109, 209, 309 between the pressure plate 112 and the bearing (not illustrated). Thus, when the first pressure rollers 105, 205, 305 are pressured to the first drive rollers 104, 204, 304, first nip portions N11, N12, N13, which are the first nip portions, are formed. In the present example, a force-applying force of the first pressuring springs 109, 209, 309 is set so that pressuring force becomes about 39 N (4 kgf).

The second pressure rollers 107, 207, 307 have both ends of the roller shafts 107*a*, 207*a*, 307*a* supported by way of a bearing (not illustrated) by the pressure plate 112. The second pressure rollers 107, 207, 307 are applied with force by second pressuring springs 108, 208, 308 between the pressure plate 112 and the bearing (not illustrated). Thus, when the second pressure rollers 107, 207, 307 are pressured to the second drive rollers 106, 206, 306, second nip portions N21, N22, N23, which are the second nip portions, are formed. In the present example, a force-applying force of the second pressuring springs 108, 208, 308 is set so that pressuring force becomes about 39 N (4 kgf).

The drive of the first drive rollers 104, 204, 304 and the second drive rollers 106, 206, 306 will be described below using FIGS. 4 and 5. FIGS. 4 and 5 are a perspective view and a side view, respectively, describing the drive of the first drive rollers 104, 204, 304 and the second drive rollers 106, 206, 306.

The first drive rollers 104, 204, 304 and the second drive rollers 106, 206, 306 are rotated when receiving a rotational driving force from motor gears MG1, MG2, MG3 of drive motors M1, M2, M3, which are drive sources. The first drive rollers 104, 204, 304 are rotated when receiving the rotational driving force through drive transmitting gears 123, 124, 125, 126, 223, 224, 225, 226, 323, 324, 325, 326. The second drive rollers 106, 206, 306 are rotated when receiving the rotational driving force through drive transmitting gears 123, 127, 128, 129, 223, 227, 228, 229, 323, 327, 328, 329.

The first pressure rollers 105, 205, 305 and the second pressure rollers 107, 207, 307 are pressured to the first drive rollers 104, 204, 304 and the second drive rollers 106, 206, 306, respectively. The first pressure rollers 105, 205, 305 and the second pressure rollers 107, 207, 307 are rotated following the rotation of the first drive rollers 104, 204, 304 and the second drive rollers 106, 206, 306.

The drive transmitting gears 124, 224, 324 out of the drive transmitting gears described above include a one-way clutch (not illustrated). The one-way clutch is locked when the first drive rollers 104, 204, 304 are rotated in the conveying direction of the sheet P, and transmits the drive of the drive motors M1, M2, M3 to the first drive rollers 104, 204, 304. The one-way clutch is a drive controller (clutch portion) that controls the transmission of the driving force to the first drive rollers 104, 204, 304 by the drive motors M1, M2, M3.

The second drive rollers 106, 206, 306 are rotated at substantially the same conveying velocity as a pair of inlet rollers 503. The first drive rollers 104, 204, 304 are set with a smaller conveying velocity than the second drive rollers 106, 206, 306. Furthermore, the first drive rollers 104, 204, 304 are set to the conveying velocity at which the sheet P does not bend by a loop formed on the upstream of the first drive rollers 104, 204, 304 when a size parallel to the conveying direction of the largest sheet P that can be passed is passed.

In the present example, the above-described conditions are satisfied at 0%<(conveying velocity of first drive roller 104, 204, 304/conveying velocity of second drive roller 106, 206, 306×100)<4%. Thus, the conveying velocity of the first drive rollers 104, 204, 304 is set to be smaller than the conveying velocity of the second drive roller 106, 206, 306 by about 2%.

Specifically, the first drive rollers 104, 204, 304 set the speed-reduction ratios of the drive transmitting gears 123, 124, 125, 126, 223, 224, 225, 226, 323, 324, 325, 326 and the drive transmitting gears 123, 127, 128, 129, 223, 227, 228, 229, 323, 327, 328, 329 to obtain the same rotation number as the second drive rollers 106, 206, 306, where outer diameters ϕ of the elastic rubbers 104*b*, 106*b*, 204*b*, 206*b*, 304*b*, 306*b* are set to 20 mm, and outer diameters ϕ of the elastic rubbers 105*b*, 107*b*, 205*b*, 207*b*, 305*b*, 307*b* are set to 19.6 mm.

In the present example, the outer diameters ϕ of the elastic rubber 104*b*, 106*b*, 204*b*, 206*b*, 304*b*, 306*b* are made greater than the outer diameters ϕ of the elastic rubber 105*b*, 107*b*, 205*b*, 207*b*, 305*b*, 307*b*, and the first drive rollers 104, 204, 304 set the speed reduction ratios of the drive transmitting gears 123, 124, 125, 126, 223, 224, 225, 226, 323, 324, 325, 326, and the drive transmitting gears 123, 127, 128, 129, 223, 227, 228, 229, 323, 327, 328, 329 to obtain the same rotation number as the second drive rollers 106, 206, 306 to apply a conveying velocity difference between the first nip portions N11, N12, N13 and the second nip portions N21, N22, N32. However, a method of applying the difference of the conveying velocity of the first nip portions N11, N12, N13 and the second nip portions N21, N22, N23 is not limited to the method of the present example. For example, the outer diameters ϕ of the elastic rubbers 104*b*, 106*b*, 204*b*, 206*b*, 304*b*, 306*b*, 105*b*, 107*b*, 205*b*, 207*b*, 305*b*, 307*b* may all be set the same, and the speed reduction ratios of the drive transmitting gears 123, 124, 125, 126, 223, 224, 225, 226, 323, 324, 325, 326 and the drive transmitting gears 123, 127, 128, 129, 223, 227, 228, 229, 323, 327, 328, 329 may be changed.

Figure 5:
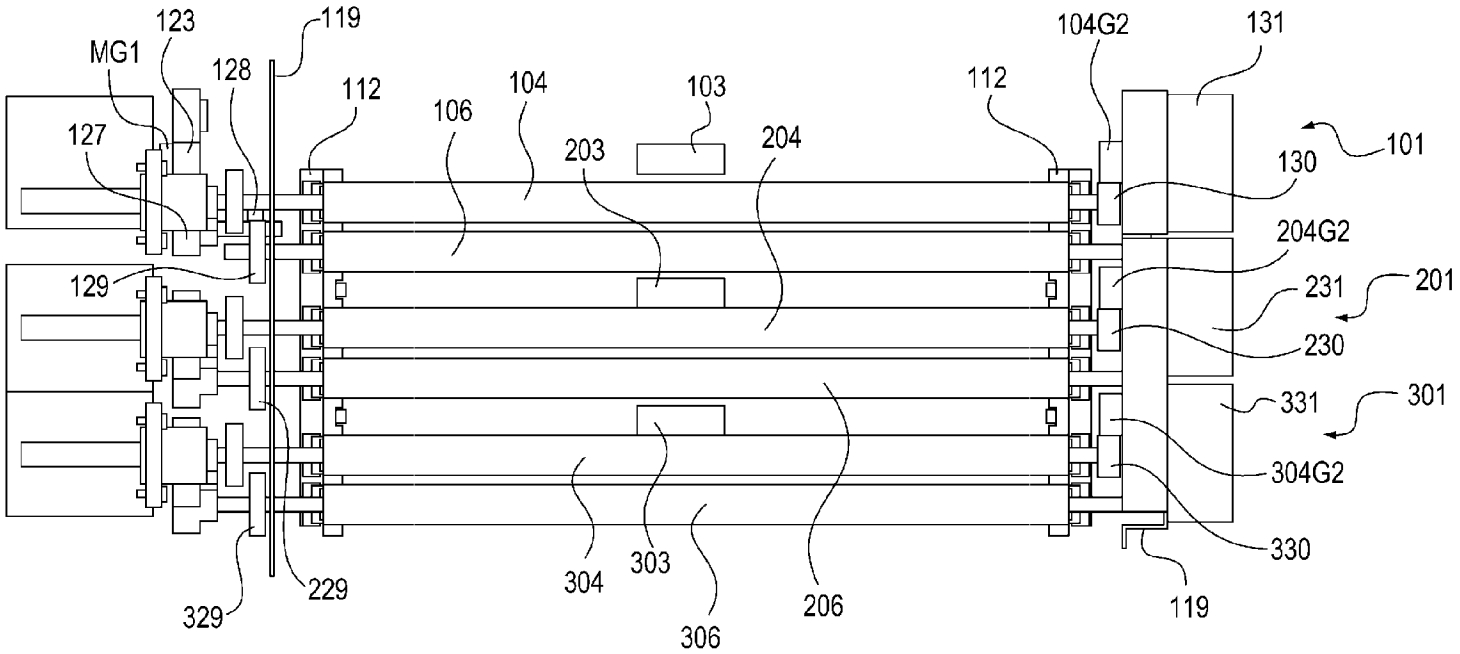
FIG. 5 is a top view illustrating the pulling conveying apparatus of the first example.

As illustrated in FIG. 5, drive gears 104G2, 204G2, 304G2 are fixed at the respective other ends of the first drive rollers 104, 204, 304, and coupled to torque applying devices 131, 231, 331 by way of the drive transmitting gears 130, 230, 330. In other words, the torque applying devices 131, 231, 331, which are torque applying devices (load portion), are coupled to the first drive rollers 104, 204, 304 configuring the first pair of rollers. The details on the configuration of the torque applying device will be described later.

In the present example, if the same sheet P exists on both the first nip portions N11, N12, N13 and the second nip portions N21, N22, N23, the set values of the torque applying devices are set such that the tension applied to the sheet P becomes about 68 N (7 kgf). The set values of the torque applying devices 131, 231, 331 are set within a range that the sheet P itself is not damaged while applying sufficient tension to the sheet P.

The operation of when the sheet P is conveyed to the sheet pulling conveying apparatus will be described below.

The sheet P is guided to the inlet guides 102, 121, 202, 221, 302, 321 in the sheet pulling conveying apparatuses 101, 201, 301, and nipped by the first nip portions N11, N12, N13 of the sheet pulling conveying apparatuses 101, 201, 301. The sheet P is conveyed by the first nip portions N11, N12, N13 at the conveying velocity set in the first nip portions N11, N12, N13 until the sheet P is nipped by the second nip portions N21, N22, N23. In the present example, the rotation number of the drive motors M1, M2, M3 is set such that the conveying velocity becomes 294 mm/s in the first nip portions N11, N12, N13.

After the sheet P is nipped by the second nip portions N21, N22, N23 of the sheet pulling conveying apparatuses 101, 201, 301, the sheet P is conveyed at the conveying velocity faster than the first nip portions N11, N12, N13 by the second nip portions N21, N22, N23. In the present example, when the first nip portions N11, N12, N13 are conveying at the conveying velocity 294 mm/s, the conveying velocity is set to become 300 mm/s in the second nip portions N21, N22, N23. At this time, the conveying velocity is faster in the second nip portions N21, N22, N23 on the downstream side in the conveying direction than the first nip portions N11, N12, N13 on the upstream side, and hence the one-way clutch idles. In other words, since the drive is not transmitted to the first drive rollers 104, 204, 304, the first pair of rollers of the sheet pulling conveying apparatuses 101, 201, 301 is rotated following the sheet P conveyed by the second pair of rollers. Furthermore, the torque applying devices 131, 132, 133 are coupled to the first drive rollers 104, 204, 304 through the drive gears 104G2, 204G2, 304G2, and the drive transmitting gears 130, 230, 330. Thus, a torque load is generated in order to rotate the first drive rollers 104, 204, 304. As a result, the sheet P is conveyed while generating a tension force between the first pair of rollers and the second pair of rollers in the sheet P.

As described above, the sheet is passed through the tension applying device of the present example to pull the central part in the width direction of the sheet in the conveying direction, so that the difference in the sheet length between the end and the central part can be reduced and the corrugation can be improved.

A configuration of the torque applying device 131, 231, 331 serving as the torque applying device or a load portion, which is a characteristic of the present example, will now be described.

Figure 6:
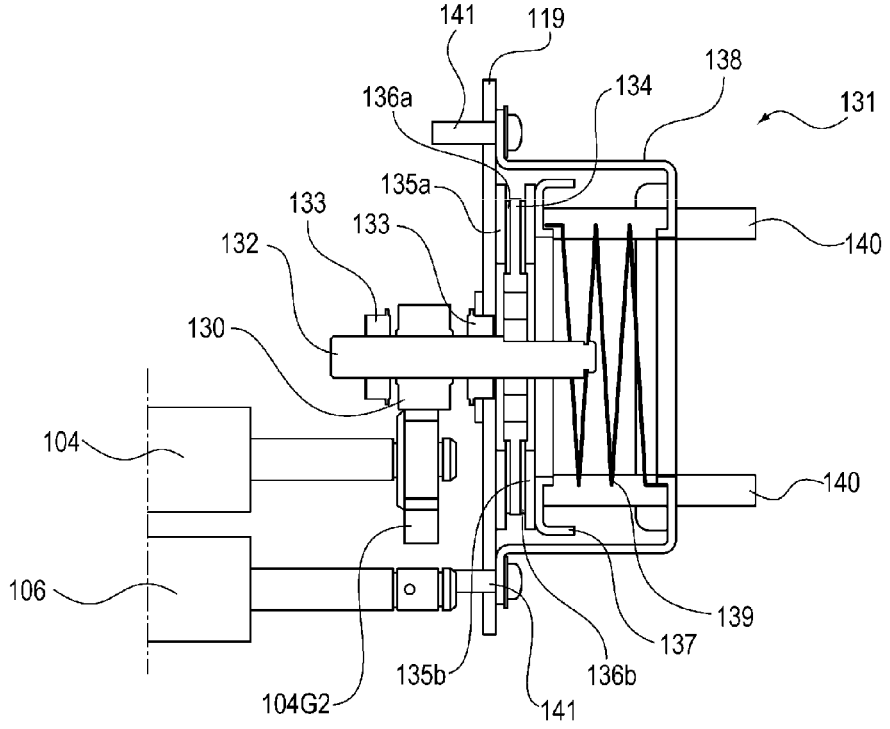
FIG. 6 is a cross-sectional view illustrating a torque applying device of the first example.
Figure 7:
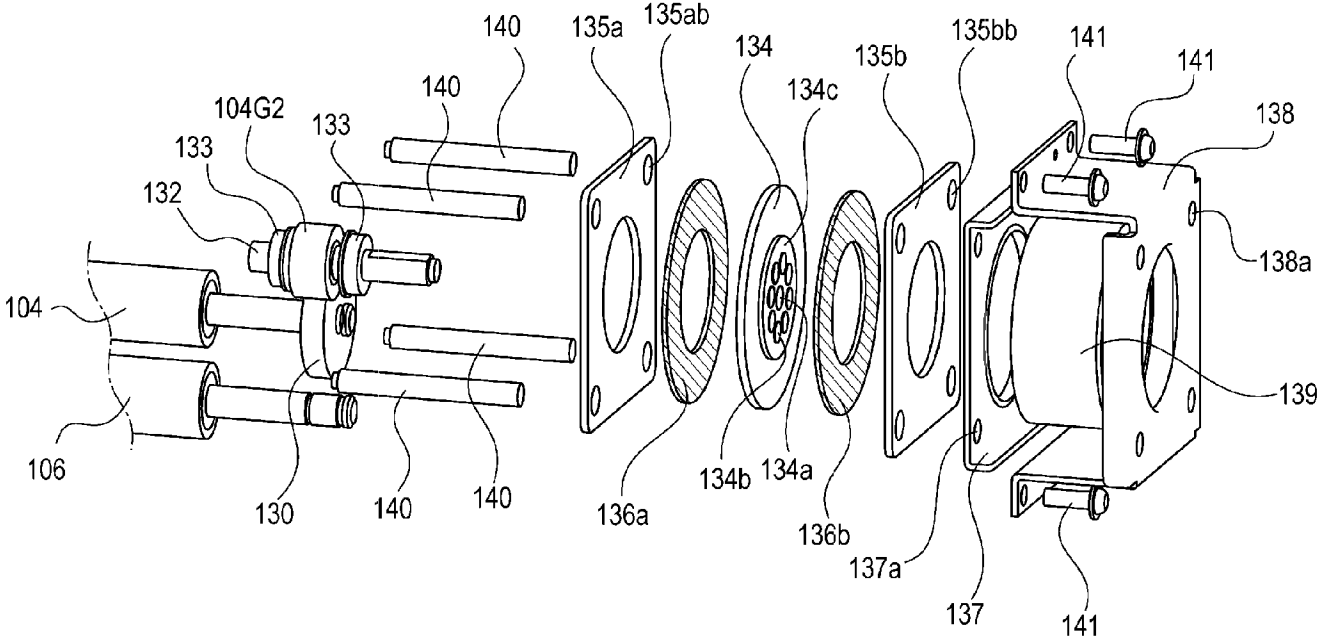
FIG. 7 is a developed view illustrating the torque applying device of the first example.

FIG. 6 is a cross-sectional view describing the torque applying device 131 of the present example, and FIG. 7 is a developed view of the torque applying device 131. The torque applying devices 231, 331 have the same configuration as the torque applying device 131, and thus the description thereof will be omitted.

The torque applying device 131 (231, 331) according to the present example includes a rotary plate (rotary member) 134, fixing plates (fixing members) 135*a*, 135*b*, slidably moving members 136*a*, 136*b*, and a force applying spring (force applying portion) 139 to be hereinafter described.

The drive gear 104G2 fixed to the first drive roller 104 rotatably drives the drive shaft 132 through the drive transmitting gear 130. The drive shaft 132 is supported by the bearing 133 fitted to the side plate 119 and a side plate (not illustrated). A fit-in hole 134*a* of the rotary plate 134 is fitted to one end of the drive shaft 132. Therefore, the rotary plate 134 is rotated when the drive shaft 132 is rotationally driven. The rotary plate 134 includes a stainless plate, a cast-iron plate, and the like, for example, and has a circular plate shape in which the outer diameter is 60 mm in the present example. The rotary plate 134 includes a plurality of holes 134*b* near (periphery) the fit-in hole 134*a*, which becomes the rotation center, thus increasing the surface area and accelerating the heat release of the rotary plate 134. Furthermore, the rotary plate 134 is fixed by way of the bearing 133 and the drive shaft 132, and thus can be parallel moved in the axial direction of the drive shaft 132.

A cylindrical boss portion (protruded portion) 134*c* is arranged on both side surfaces at the rotation center of the rotary plate 134. The ring-shaped slidably moving members 136*a*, 136*b* are fitted to the boss portion 134*c* of the rotary plate 134. The side surfaces of the rotary plate 134 thus make contact with the slidably moving members 136*a*, 136*b*. The slidably moving members 136*a*, 136*b* of the present example are made from a heat resistant resin such as PTFE, PPS, PEEK, for example, where the outer diameter is 60 mm, the inner diameter is 30 mm, and the thickness is 1 mm. The slidably moving member 136*a* and the slidably moving member 136*b* are respectively arranged so as to be nipped from the outer side by the fixing plate 135*a* and the fixing plate 135*b*.

The fixing plates 135*a*, 135*b* have guide holes 135*ab*, 135*bb*, which are opened in each fixing plate 135*a*, 135*b*, fitted to a guide shaft 140 fixed to the side plate 119 to parallel move in the axial direction of the guide shaft 140 and be rotation regulated at the same time. The fixing plate 135*a* is arranged to bring a surface on one side into contact with the side plate 119. The fixing plate 135*b* is arranged to nip the rotary plate 134, fitted with the slidably moving members 136*a*, 136*b*, between the fixing plate 135*b* and the fixing plate 135*a*. Thus, the fixing plates 135*a*, 135*b* respectively have the side surface on one side brought into contact with the slidably moving members 136*a*, 136*b*.

A pressure member 137 is brought into contact with a surface on the side opposite to the slidably moving member 136*b* of the fixing plate 135*b*. The pressure member 137 also has the guide hole 137*a* fitted to the guide shaft 140 to parallel move in the axial direction of the guide shaft 140 and be rotation regulated at the same time. The pressure member 137 is pressurized to apply force to the fixing plate 135*b* in the axial direction of the rotary plate 134 by the force applying spring 139 held by a pressuring holding member 138.

Figure 8:
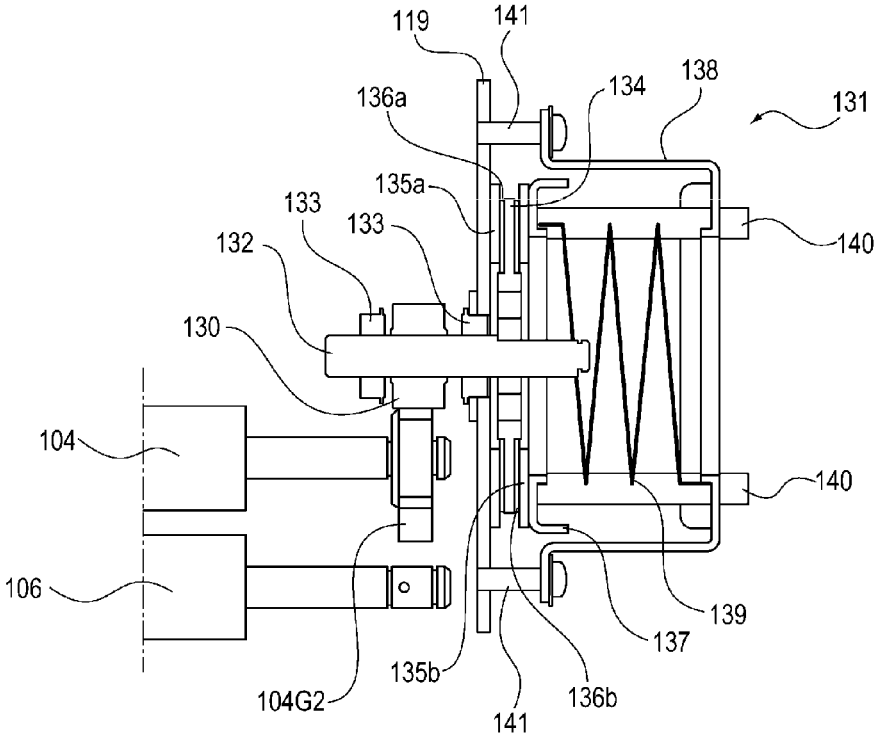
FIG. 8 is a cross-sectional view illustrating the torque applying device of the first example.

The pressuring holding member 138 has the guide hole 138*a*, which is opened in the pressuring holding member 138, fitted to the guide shaft 140 to parallel move in the axial direction of the guide shaft 140 and be rotation regulated at the same time. The pressuring holding member 138 is also fixed to the side plate 119 by way of an adjustment bis 141. Thus, as illustrated in FIG. 8, the spring length of the force applying spring 139 is changed by changing the fastening length of the adjustment bis 141, so that the pressuring force with respect to the fixing plate 135*b* of the pressure member 137 can be adjusted.

According to the configuration described above, the slidably moving member 136*b* is configured such that one side surface is pressurized by the fixing plate 135*b* and the other side surface pressurizes the rotary plate 134. Furthermore, the slidably moving member 136*a* is configured such that one side surface is pressurized by the rotary plate 134 and the other side surface pressurizes the fixing plate 135*a*.

According to the configuration described above, when the first drive roller 104 is rotated, the rotary plate 134 is rotated through the drive gear 104G2, the drive transmitting gear 130, and the drive shaft 132. Accompanying the rotation of the rotary plate 134, the slidably moving members 136*a*, 136*b* are rotated while slidably moving at the contacting surface with the rotary plate 134 and the contacting surface with the fixing plates 135*a*, 135*b*. At this time, the frictional force is generated in the rotation direction between the slidably moving members 136*a*, 136*b* and the rotary plate 134 and between the slidably moving members 136*a*, 136 and the fixing plates 135*a*, 135, so that the torque load is generated to drive rotate the drive shaft 132. That is, the torque load is generated while rotating the first drive roller 104.

The magnitude of the torque load on the drive shaft 132 is determined by the friction coefficient μ of each contacting surface, the pressuring force N, the average rotation radius R, and the number n of slidably moving contacting surfaces in the slidably moving members 136*a*, 136*b*, the rotary plate 134, and the fixing plates 135*a*, 135*b*. That is, if the friction coefficient μ of each contacting surface is assumed as constant, the torque T on the drive shaft 132 is expressed as below.

$$T=n\mu NR$$

The magnitude Tr of the torque load of the first drive roller 104 is determined by the torque T of the drive shaft 132, and the gear ratio G of the drive gear 104G2 (number of teeth G1) and the drive transmitting gear 130 (number of teeth G2). That is, the following is obtained from the above equation.

$$Tr=TG=n\mu NR(G1/G2)$$

As a result of the above, the sheet P is conveyed while generating the tension force (tension of the conveying direction) between the first pair of rollers and the second pair of rollers in the sheet P.

In the present example, the set value of the torque applying device 131 is set so that the tension applied on the sheet P becomes about 68 N (7 kgf). Furthermore, if the conveying velocity is about 300 mm/s, the rotation number of the torque applying device becomes a high speed rotation (600 rpm in the present example), and the temperature of the torque applying device rises. In the present example, each contacting surface temperature of the slidably moving members 136*a*, 136*b*, the rotary plate 134, and the fixing plates 135*a*, 135*b* rises up to about 160° C. at the time of continuous use.

Generally, when applying the rotation load of the roller, the powder seal member and the bearing, which are configuring components, in the powder brake, for example, become high temperature during the high rotation continuous use, and the torque may rapidly rise, the durability may degrade, and breakage may occur.

Thus, the usage temperature limit (lower than or equal to 80° C.) is provided in the conventional powder brake, and use needs to be made at the torque and the rotation number that do not exceed the usage temperature limit. Therefore, the conventional powder brake is unusable under the conditions of high torque load and high rotation number as in the present example.

On the contrary, the torque applying device 131 of the present example can be used even at a high temperature of higher than or equal to 100° C. since the slidably moving members 136*a*, 136*b*, the rotary plate 134, and the fixing plates 135*a*, 135*b*, which are configuring components, are made of heat resistant resin and metal.

As a result, the sheet is passed through the sheet pulling conveying apparatus of the present example to pull the central part in the width direction of the sheet in the conveying direction, so that the difference in length in the conveying direction of the sheet between the end in the width direction and the middle is further reduced and the corrugation of the sheet can be more effectively improved.

In the description made above, the configuration of changing the spring length of the force applying spring 139 by changing the fastening length of the adjustment bis 141 so that the pressuring force with respect to the fixing plate 135*b* of the pressure member 137 can be adjusted has been described, but the present invention is not limited thereto.

Figure 18A:
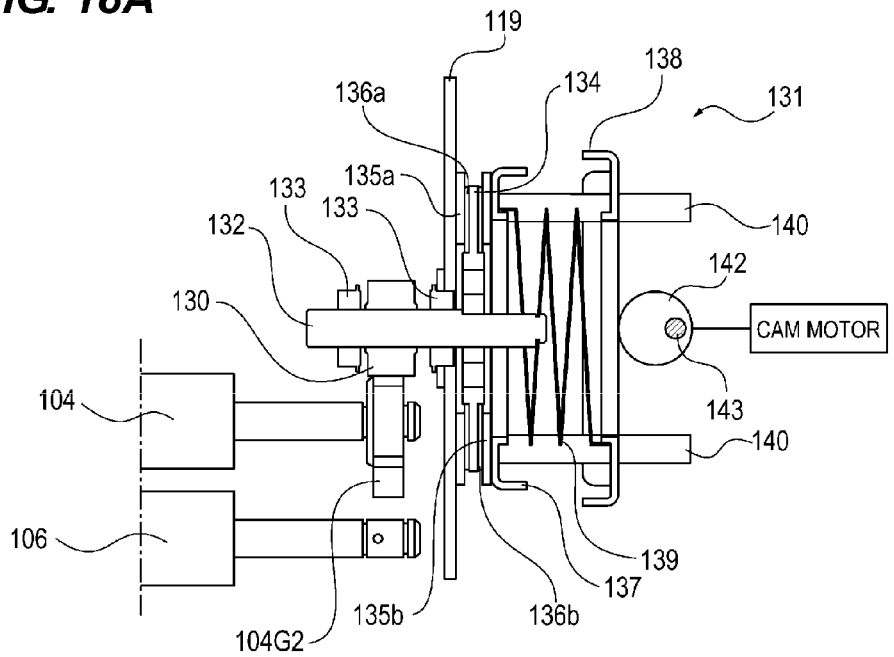
FIGS. 18A and 18B are cross-sectional views illustrating the torque applying device of the first example.
Figure 18B:
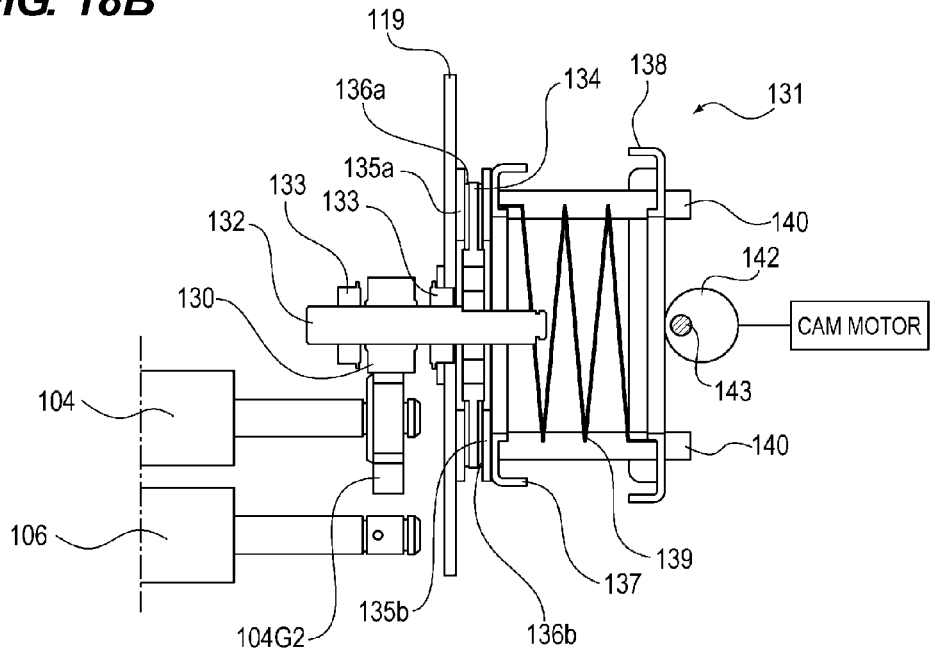

For example, as illustrated in FIGS. 18A and 18B, the spring length of the force applying spring 139 may be changed by rotating a cam 142 rotatably arranged with a rotation center 143 as the center by a cam motor M that generates the driving force. In other words, the cam motor M and the cam 142 function as a changing portion for changing the force-applying force of the force applying spring 139.

In FIG. 18A, the spring length by the force applying spring 139 is short and the pressuring force with respect to the fixing plate 135*b* of the pressure member 137 is large, and hence the torque load is large. In FIG. 18B, on the other hand, the spring length by the force applying spring 139 is long and the pressuring force with respect to the fixing plate 135*b* of the pressure member 137 is small, compared to the state of FIG. 18A, and hence the torque load is small.

The CPU controls the cam motor M and rotates the cam 142 according to the information associated with the conveying sheet to change the torque load. The information associated with the sheet includes a basis weight of the sheet, the type of sheet (whether plain paper or coated paper), image density, and moisture amount contained in the sheet.

The information associated with the sheet is input by the user using an operation panel 570 (see FIG. 2), and transmitted to the controller 500C including the CPU and the memory in the printer 500 illustrated in FIG. 3. Alternatively, the information associated with the sheet P may be detected by a detection sensor 500D installed on the upper part of the sheet cassette 520 in the printer 500, and such detection information may be transmitted to the controller 500C including the CPU and the memory. Furthermore, the information associated with the sheet may be input from an external computer connected to the printer 500. The operation panel, the detection sensor, and the external computer are examples of an acquiring portion for acquiring the information associated with the sheet.

For example, when acquired by the acquiring portion as being a cardboard in which the basis weight of the sheet is large, the CPU rotates the cam 142 and shortens the spring length by the force applying spring 139. The pressuring force with respect to the fixing plate 135*b* of the pressure member 137 thus becomes large and the torque load becomes large, whereby the pulling force on the sheet can be made strong. This is because in the case of the cardboard, the sheet needs to be pulled with a strong force to correct the corrugation.

When acquired by the acquiring portion as being a thin paper in which the basis weight of the sheet is small, the CPU rotates the cam 142 and lengthens the spring length by the force applying spring 139. The pressuring force with respect to the fixing plate 135*b* of the pressure member 137 thus becomes small and the torque load becomes small, whereby the pulling force on the sheet can be made weak. In the case of the thin paper, the sheet may rip if the sheet is pulled with a strong force same as the cardboard, which is not preferable.

The CPU shortens the spring length by the force applying spring 139 when the moisture amount contained in the sheet is large compared to when the moisture amount contained in the sheet is small. Furthermore, the CPU shortens the spring length by the force applying spring 139 in the case of the high density image (toner density of greater than or equal to 50%) compared to the low density image.

The characteristics and the measurement method of the shape of the curl and the end corrugation produced in the sheet P will be described in FIG. 9. The corrugation of the sheet is measured with the sheet P that passed through only the nip portion N of the fixing device 100 placed on a measurement press platen 700 illustrated in FIG. 9. Alternatively, the corrugation of the sheet is measured with the sheet P that passed through the nip portion N of the fixing device 100 and then passed through the sheet pulling conveying apparatuses 101, 201, 301, as illustrated in FIG. 10, placed on the measurement press platen 700 illustrated in FIG. 9. An end length of the sheet P in the sheet conveying direction is L edge [mm] and a center length is L center [mm].

Figure 9:
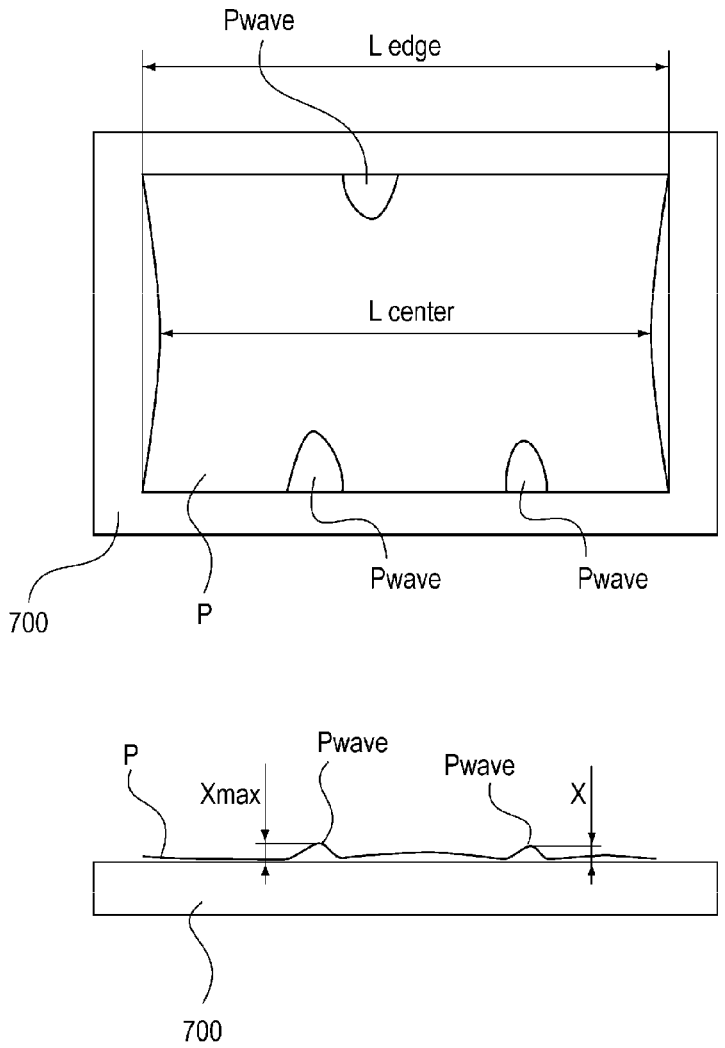
FIG. 9 is an outer appearance view illustrating a shape of a sheet.

With an upper side or a lower side of the sheet P illustrated in FIG. 9, that is, a curve shape Pwave generated at the end in the width direction orthogonal to the conveying direction referred to as the end corrugation, an end having a maximum gap X max with the measurement press platen 700 is evaluated as a corrugation amount.

FIG. 10 illustrates the result of an effect checking test of the pulling conveying apparatuses 101, 201, 301 in the present example conducted by the inventors of the present invention. FIG. 10A describes the end length L edge [mm], the center length L center [mm], or the maximum corrugation amount X max [mm] of the sheet P in a state immediately after being passed through the fixing device 100 but not passed through the sheet pulling conveying apparatus of the present example. FIG. 10B describes the end length L edge [mm], the center length L center [mm], or the maximum corrugation amount X max [mm] of the sheet P immediately after being passed through the sheet pulling conveying apparatuses 101, 201, 301 of the present example after being passed through the fixing device 100.

As illustrated in FIG. 10A, the stretch amount of the center length L center of the sheet P is 0 mm whereas the stretch amount of the end length L edge is 0.6 mm immediately after passing the fixing device, and thus the stretch amount is longer at the end than at the middle by 0.6 mm. This is because in the case of the fixing device including the wide nip, as previously described, the rubbing action is applied to the sheet by setting the conveying velocity on the end side higher than at the central part in the width direction of the sheet in the nip portion to prevent wrinkles of the sheet in the course the sheet passes the nip portion. In such a case, the end in the width direction of the sheet stretches in the conveying direction than the vicinity of the middle after being discharged from the nip portion.

Then, as illustrated in FIG. 10B, when the sheet is passed in the order of the first sheet pulling conveying apparatus 101, the second sheet pulling conveying apparatus 201, and the third sheet pulling conveying apparatus 301 of the present example after being passed through the fixing device, the stretch amount of the center length L center immediately after the passing is 0.6 mm. Assume that each sheet passing velocity is as follows: fixing device (sheet passed at 300 mm/s), first pulling conveying apparatus 101 (sheet passed at 300 mm/s), second sheet pulling conveying apparatus 201 (sheet passed at 298.5 mm/s), and third sheet pulling conveying apparatus 301 (sheet passed at 294 mm/s) of the present example. On the contrary, the stretch amount of the end length L edge is 0.6 mm, and hence the difference in length of the end and the middle is 0 mm. That is, the central part in the width direction of the sheet P is pulled in the conveying direction by passing the sheet P through the first sheet pulling conveying apparatus 101, the second sheet pulling conveying apparatus 201, and the third sheet pulling conveying apparatus 301, so that the central part in the width direction of the sheet is stretched in the conveying direction and the difference of the end and the middle is further reduced. As a result, the maximum corrugation amount, which was 3.3 mm as illustrated in FIG. 10A, improved to 1.0 mm illustrated in FIG. 10B as the difference in the sheet length of the end and the middle is reduced.

As described above, through the use of the torque applying device of the present example, the tension force can be sufficiently applied to the sheet and the corrugation of the sheet can be improved even if the torque applying device becomes a high temperature due to the high speed rotation.

Figure 11:
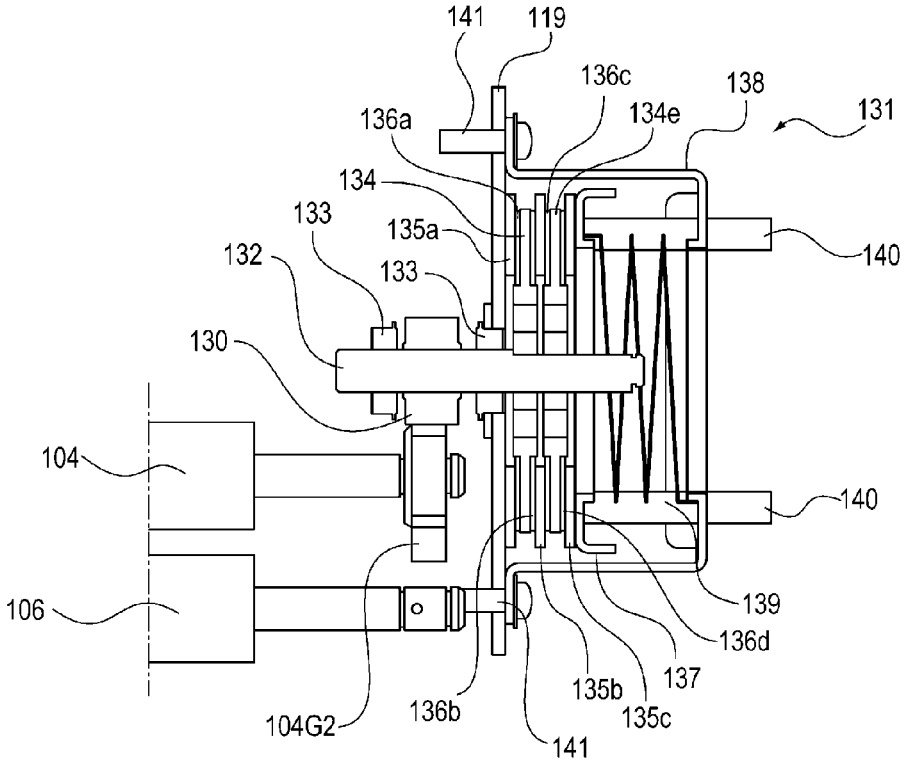
FIG. 11 is a cross-sectional view illustrating a torque applying device of the first example.

When further enhancing the torque load with respect to the present example, a slidably moving unit, including one rotary plate and two slidably moving members, may be arranged in plurals in the axial direction, and a fixing plate may also be arranged between the adjacent slidably moving units. Specifically, for example, two rotary plates 134, 134*e*, four slidably moving members 136*a*, 136*b*, 136*c*, 136*d*, and three fixing plates 135*a*, 135*b*, 135*c* may be used as illustrated in FIG. 11, and such components may be arranged in series. According to such configuration, the number of slidably moving contacting surfaces can be increased and the torque load can be enhanced.

Figure 12:
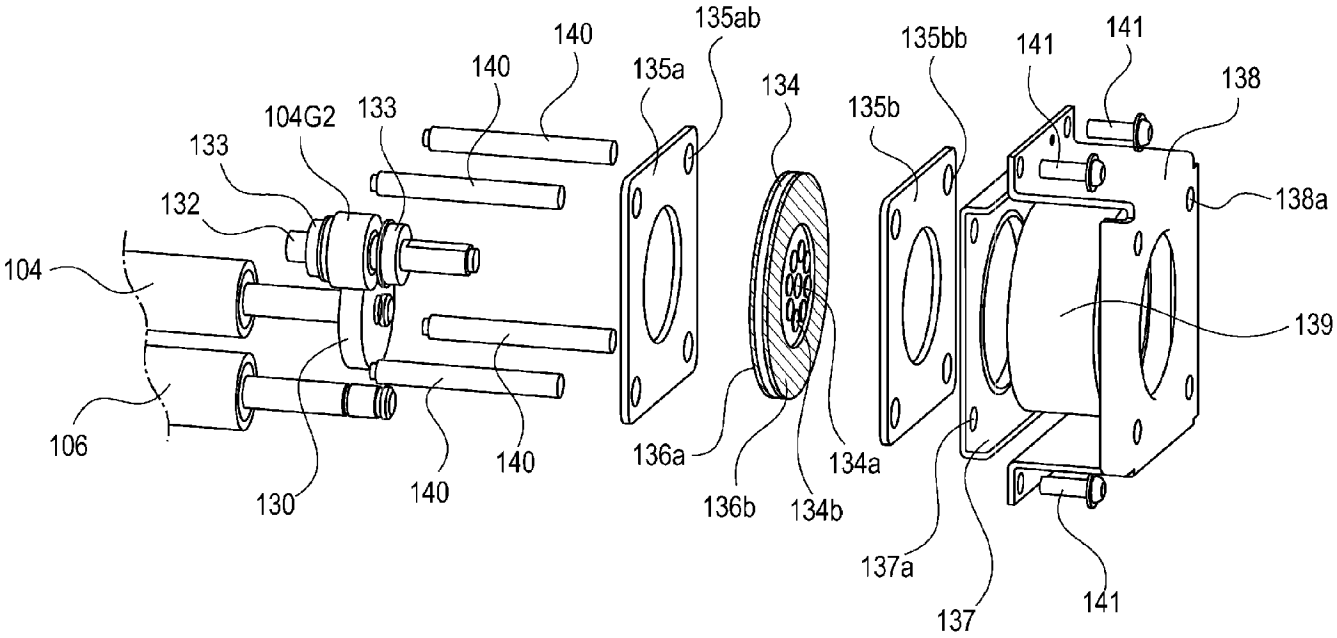
FIG. 12 is a developed view illustrating the torque applying device of the first example.
Figure 13:
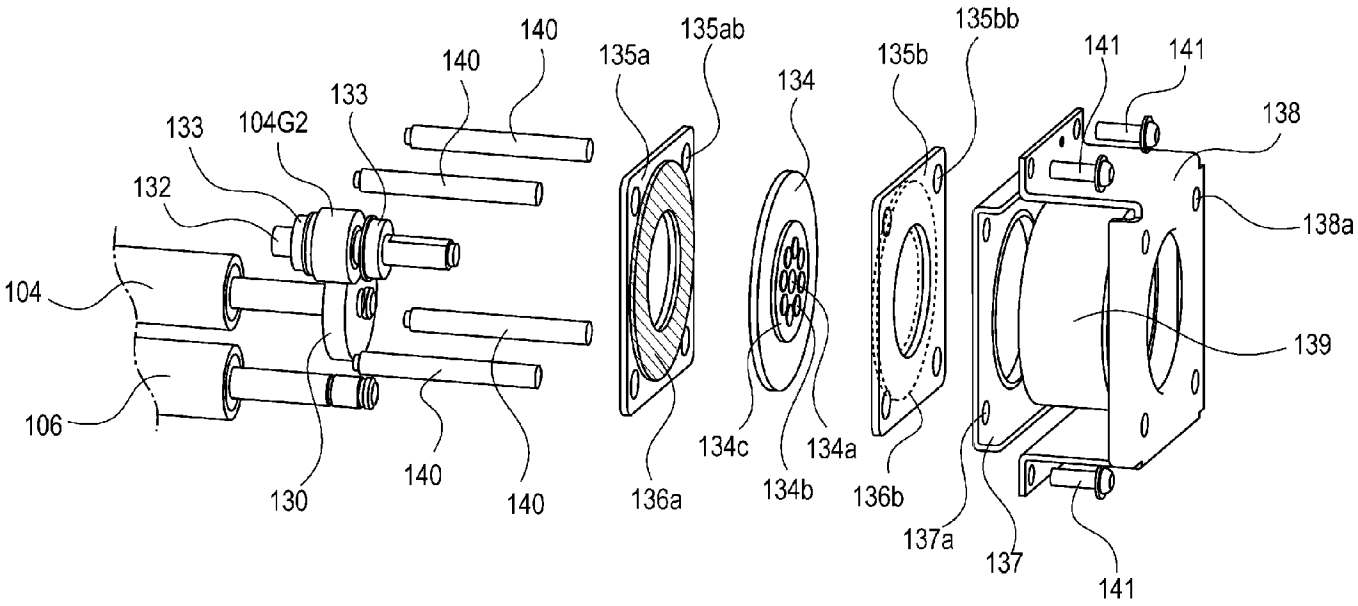
FIG. 13 is a developed view illustrating the torque applying device of the first example.

With respect to the present example, the slidably moving members 136*a*, 136*b* may be adhered and fixed with the rotary plate 134, as illustrated in FIG. 12, or may be adhered and fixed with the fixing plates 135*a*, 135*b* as illustrated in FIG. 13.

Second Example

Figure 14:
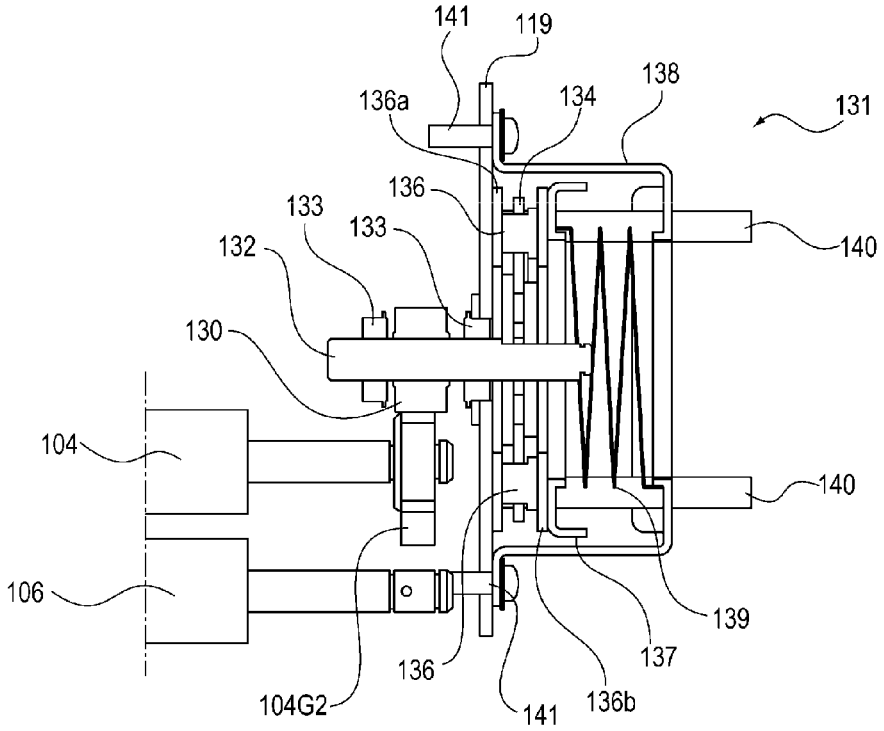
FIG. 14 is a cross-sectional view illustrating a torque applying device of a second example.
Figure 15:
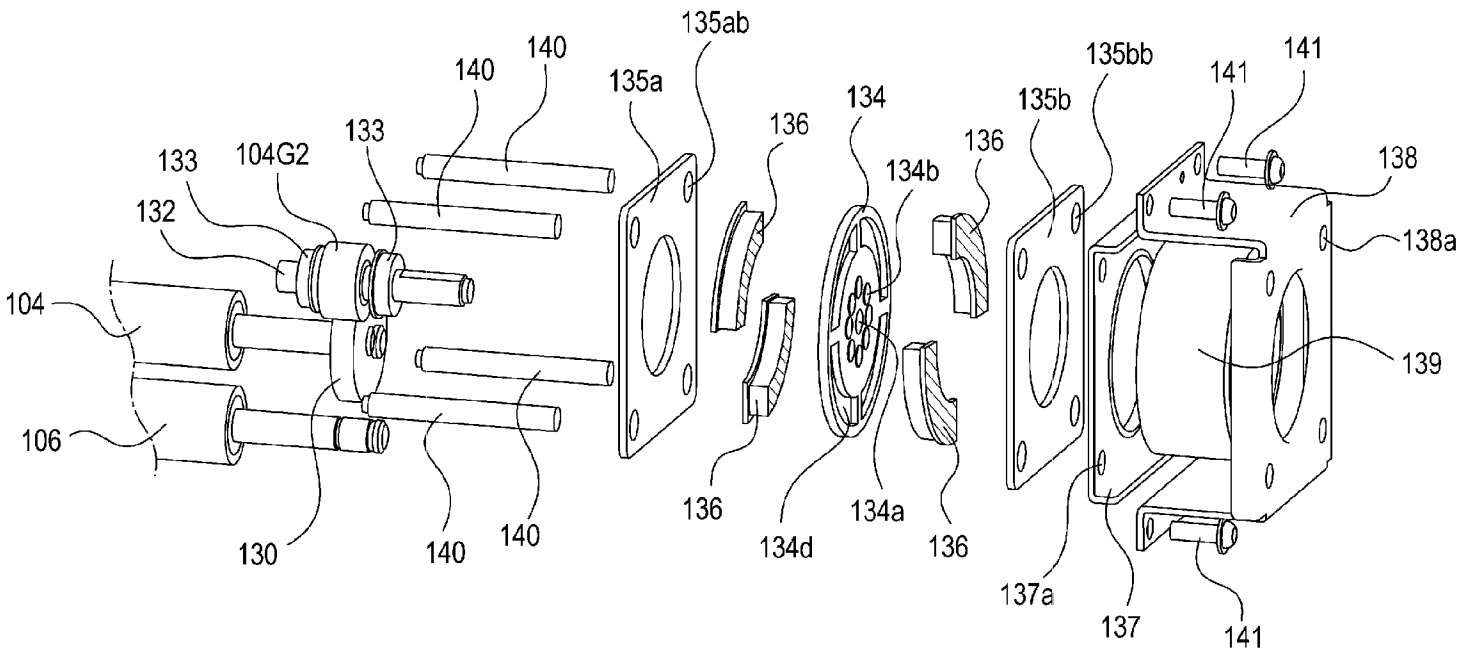
FIG. 15 is a developed view illustrating the torque applying device of the second example.

A configuration of the torque applying device 131 of the present example will now be described using FIGS. 14 and 15. FIG. 14 is a cross-sectional view describing the torque applying device 131 of the present example, and FIG. 15 is a developed view of the torque applying device. The configurations other than the torque applying device are similar to the example described above, and hence the description thereof will be omitted. Furthermore, in the torque applying device, the same reference numerals are denoted on the configurations similar to the example described above, and the description thereof will be omitted.

In the present example, a circular hole (hole portion) 134*d* divided along the outer circumferential surface is formed in the rotary plate 134, where the center of the circular shape is the turning center of the rotary plate 134. The plurality of slidably moving members 136 is inserted to the divided circular holes 134*d*, and both outer sides of the rotary plate 134, to which the plurality of slidably moving members 136 is inserted, are nipped by the fixing plates 135*a*, 135*b*, similar to the first example. In other words, the slidably moving member 136 is inserted to each hole 134*d* of the rotary plate 134, and nipped with the fixing plates 135*a*, 135*b* from both outer sides in the axial direction of the plurality of slidably moving members 136 projecting out from both side surfaces of the rotary plate 134.

According to the configuration described above, the slidably moving member 136 is rotated when the rotary plate 134 is rotated, and the torque load can be generated by the slidable movement of the slidably moving member 136 and the fixing plates 135*a*, 135*b*, similar to the first example.

As described above, through the use of the torque applying device of the present example, the tension force can be sufficiently applied to the sheet and the corrugation of the sheet can be improved even if the torque applying device becomes a high temperature due to the high speed rotation.

Figure 16:
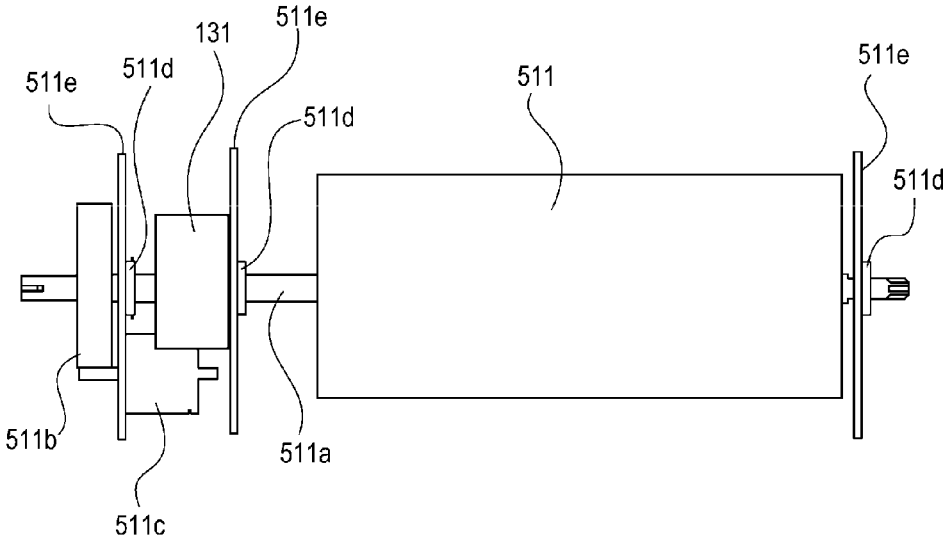
FIG. 16 is a cross-sectional view illustrating other usage methods of the torque applying device of the first and second examples.

In the example described above, the configuration of the torque applying device used in the sheet pulling conveying apparatus has been described by way of example, but this is not the sole case as long as the rotation torque is applied on a steady basis. For example, as illustrated in FIG. 16, use can be made as the torque applying device of the photosensitive drum 511. FIG. 16 is a cross-sectional view describing the photosensitive drum 511 of the present example.

The photosensitive drum 511 has a photosensitive drum shaft 511*a* supported by a bearing 511*d* fitted into a side plate 511*e*, and is rotated when a drive motor 511*c* is driven through a drive transmitting gear 511*b*. The torque applying device 131 of the present example is connected to the photosensitive drum shaft 511*a*, so that the torque load is applied when the photosensitive drum shaft 511*a* is rotated. As the torque load is applied to the photosensitive drum shaft 511*a*, the rotational shift of when the photosensitive drum rotates can be prevented from occurring, and a satisfactory toner image can be formed.

A configuration in which a humidifying device for humidifying the sheet is arranged on the upstream of the sheet conveying direction of the sheet pulling conveying apparatus including the first pair of rollers and the second pair of rollers described above may be adopted. After humidifying the sheet with the humidifying device, the tension in the conveying direction is applied on the sheet by the sheet pulling conveying apparatus to more effectively apply the tension on the sheet.

Figure 17:
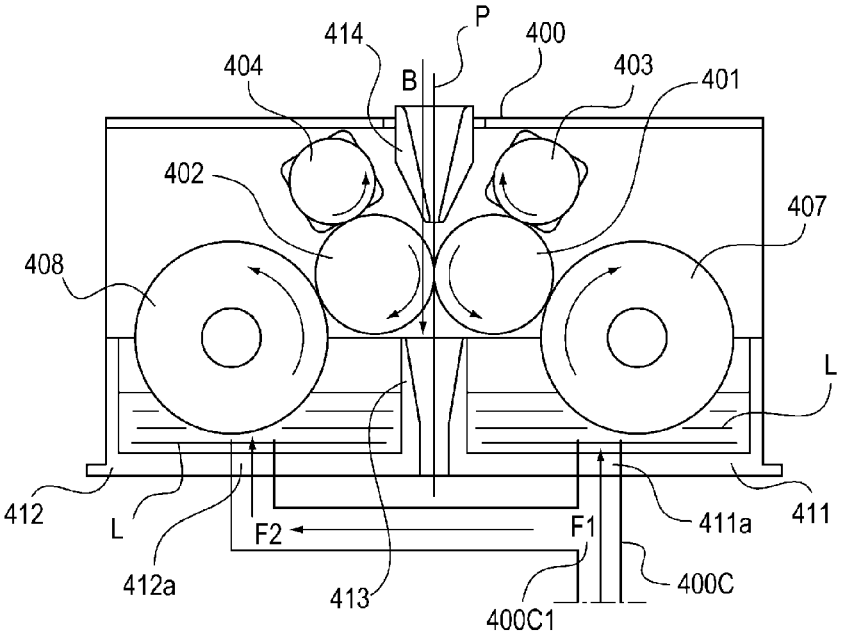
FIG. 17 is a cross-sectional view of a humidifying device of the first and second examples.

The configuration illustrated in FIG. 17 can be used for such humidifying device. A humidifying device 400 will be described below using FIG. 17. FIG. 17 is a cross-sectional view of the humidifying device 400.

The sheet P fed in the direction of an arrow B in FIG. 17 enters the nip portion of a pair of humidification rollers 401, 402 by being guided by an inlet guide 414. A humidifying solution L is transferred onto the surface (both surfaces) of the sheet P by the pair of humidification rollers 401, 402 to humidify the sheet P.

The pair of humidification rollers 401, 402 are both elastic rollers in which a solid rubber layer having NBR, silicon, and the like as a main component is formed on a shaft core surface including a metal rigid body made of stainless steel and the like.

Feeding rollers 407, 408 are feeding members for sequentially feeding the humidifying solution L to the humidification rollers 401, 402. The feeding rollers 407, 408 are elastic rollers in which a solid rubber layer having a material, with hydrophilic surface that can hold the humidifying solution L, such as NBR as a main component, for example, NBR is formed on the shaft core surface including the metal rigid body made of stainless steel, and the like. The solid rubber layer may use metal or hydrophilic processed resin.

The humidifying solution L contained in a storage reservoir (not illustrated) containing the humidifying solution L for humidifying the sheet P is fed, as needed, toward feed cisterns (storage portions) 411, 412 of the humidifying device 400 with a feed pump (not illustrated). The solution is fed, as needed, in the direction of the arrows F1, F2 through a branched portion 400C1 provided in a feeding pipe 400C toward the feed cisterns (storage portions) 411, 412 of the humidifying device 400. The main component of the humidifying solution L is water, and a solution containing a surface acting agent is used in view of the humidifying efficiency and the permeability to the sheet P. The respective branched pipes of the feeding pipe 400C are coupled to feeding holes 411*a*, 412*a* provided substantially immediately below the feeding rollers 407, 408 at the bottom portion of the feed cisterns 411, 412.

The humidifying solution held at the surface layer of the feeding rollers 407, 408 is further transferred to the surface layer of each humidification roller 401, 402, and at the same time, squeezed from each scraping roller 403, 404. Therefore, the humidifying solution L is transferred to the surface layer of each humidification roller 401, 402 while maintaining uniformity. The scraping rollers 403, 404 are made from a material in which hard chrome plating process is performed on a stainless steel or an iron steel surface.

The humidification roller 401, the feeding roller 408, and the scraping roller 404 are pressured (applied with force) by the humidification roller 402 with a pressuring spring (not illustrated). The feeding roller 407 and the scraping roller 403 are pressured (applied with force) by the humidification roller 401 with the pressuring spring (not illustrated).

As illustrated in FIG. 1, the sheet P that passed through the humidifying device 400 is guided between the guides 501, 502, conveyed to the pair of inlet rollers 503, 504, and guided to between the inlet guides 102, 121 in the sheet pulling conveying apparatus 101. The subsequent operation is as described above.

Therefore, with the humidifying device for humidifying the sheet arranged on the upstream side of the sheet pulling conveying apparatus, the tension in the conveying direction is applied to the sheet by the sheet pulling conveying apparatus after the sheet is humidified by the humidifying device so that the tension can be more effectively applied to the sheet.

Third Example

A third example will be described using FIG. 19. The present example adopts the same configuration other than that only the pulling conveying apparatus in the sheet processing apparatus of the first example is changed. Therefore, the description other than the pulling conveying apparatus will be omitted.

The difference with the first example lies in that the pair of rotating members on the downstream side in the conveying direction of the sheet P is a pair of belts. As illustrated in FIG. 19, the sheet P is wound around a second drive belt 147 and pulled to obtain sheet stretching.

The pair of belts includes the second drive belt 147 and a second pressuring belt 148. The second drive belt 147 includes a second drive endless belt 133, a second drive roller 106, a second drive side endless belt roller 135, and a second drive side pressuring pad 137. The second pressuring belt 148 includes a second pressuring endless belt 134, a second pressure roller 107, a second pressuring side endless belt roller 136, and a second pressuring side pressuring pad 138. In addition, a pair of rollers including the first drive roller 104 and the first pressure roller 105, which are the pair of rotating members on the upstream side, corresponds to the configuration of the first example, and hence the detailed description thereof will be omitted.

Figure 19:
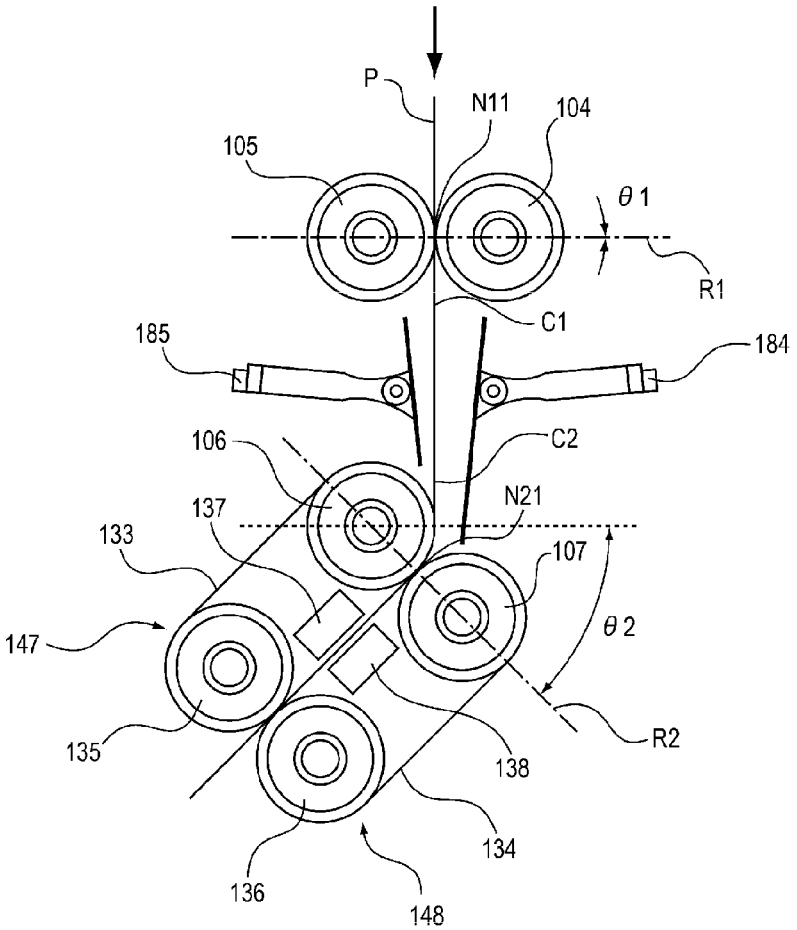
FIG. 19 is a cross-sectional view illustrating a pulling conveying apparatus of a variant of a third example.

When the sheet P is conveyed to the pulling conveying apparatus illustrated in FIG. 19, the sheet P passes the first nip portion N11 formed by the first drive roller 104 and the first pressure roller 105. Thereafter, the sheet P is guided to sheet guide 184, 185, and passed through the second nip portion N21 formed by the second drive belt 147 and the second pressuring belt 148. The tension force is applied to the sheet P when the sheet P is simultaneously passing the first nip portion N11 and the second nip portion N21. When the tension force is applied to the sheet P, the sheet P forms a conveyance path C1 at the downstream side of the first nip portion N11. Furthermore, the sheet P forms a conveyance path C2 at the upstream side of the second nip portion N21. In FIG. 19, the conveyance path C1 and the conveyance path C2 are on the same straight line. On the conveyance path C2, the sheet P is wound around the second drive belt 147 at a second winding angle θ2.

In this case, if the sheet P is wound around the second drive belt 147 at the second winding angle θ2, the bending stress is applied at the same time as the tensile stress on the sheet P. Thus, when pulling the sheet P while applying the bending stress, the tension can be efficiently applied to the sheet compared to when the sheet is simply pulled straight. When the tensile stress and the bending stress exceed a bearing force of the sheet P, a plastic stretching occurs with respect to the sheet P.

The magnitude relationship of θ1 and θ2 is not limited to the present example. $\theta 1>\theta 2$, $\theta 1<\theta 2$, $\theta 1\approx\theta 2$ may be adopted.

FIG. 19 illustrates a configuration of pulling the sheet P while bending. A straight line connecting the rotation center of the first drive roller 104 and the rotation center of the first pressure roller 105 is assumed as a roller center line R1. A straight line connecting the rotation center of the second drive roller 106 and the rotation center of the second pressure roller 107 is assumed as a roller center line R2.

The second pair of belts 147, 148 is tilted with respect to the first pair of rollers 104, 105 arranged perpendicular to the conveyance path C2. In other words, the center line R2 is tilted with respect to the center line R1, and is not parallel thereto.

The sheet P can be wound around at least one of the first pair of rollers (first pair of rotating members) or the second pair of belts (second pair of rotating members) of the plurality of pairs of rotating members by adopting the configuration in which the center line R1 and the center line R2 are not parallel.

In the case in which the first pair of rotating members is a pair of belts, a line connecting the rotation centers of the pair of rollers on the downstream side in the sheet conveying direction of the rollers applied with the belt is assumed as the center line R1. In the case in which the second pair of rotating members is a pair of belts, a line connecting the rotation centers of the pair of rollers on the upstream side in the sheet conveying direction of the rollers applied with the belt is assumed as the center line R2.

In FIG. 19, when applying the tension to the sheet P while winding the sheet P around the second drive belt 147, the pressuring force between the nips of the pair of rollers needs to be made large to a certain extent as described in the first example.

In the present example, the second drive roller 106 applied with the second drive belt 147 is a fixed roller that is fixed to the side plate can only be rotated. This prevents the pressuring force between the nips of the pair of belts from becoming small.

Therefore, even if the pair of rollers is not used and the pair of belts is used for the pair of rotating members, the effects similar to the first example can be obtained by applying the torque applying device 131 as described in the first example. In the configurations of the first and second examples, similar effects can be obtained even with the configuration in which the pair of rollers is replaced with the pair of belts.

In the third example, the second pair of rotating members on the downstream side of the conveying direction of the sheet P is assumed as the pair of belts, but this is not the sole case. The pair of rotating members on the upstream side in the conveying direction of the sheet P may be assumed as the pair of belts.

As described above, an effect of being able to efficiently pull the sheet P can be obtained in the third example as well, similar to the first and second examples.

Moreover, the conveying force can be enhanced by replacing the pair of rollers configuration in the first and second examples with the pair of belts configuration.

Other Examples

In the examples described above, a configuration of coupling three sheet pulling conveying apparatuses for sheet passing has been described for the sheet pulling conveying apparatus of the sheet conveying apparatus, but this is not the sole case. One or two sheet pulling conveying apparatuses may be coupled, or three or more sheet pulling conveying apparatuses may be coupled for sheet passing, as necessary.

In the examples described above, a configuration of coupling the plurality of sheet pulling conveying apparatuses in a longitudinal direction (gravity direction, vertical direction) in the sheet conveying apparatus freely detachable as an optional external device with respect to the image forming apparatus has been described, but this is not the sole case. The plurality of sheet pulling conveying apparatuses may be coupled in a horizontal direction (direction intersecting the vertical direction) in the sheet conveying apparatus freely detachable as an optional external device with respect to the image forming apparatus. The optional external device with respect to the image forming apparatus is not limited to the freely detachable sheet conveying apparatus. For example, in the sheet conveying apparatus integrally arranged in the image forming apparatus, the plurality of sheet pulling conveying apparatuses may be coupled in the horizontal direction (direction intersecting the vertical direction) or may be coupled in the longitudinal direction (gravity direction, vertical direction). Similar effects can be obtained in the image forming system as a whole by applying the present invention to such sheet conveying apparatus.

The configuration of controlling the operation of the sheet pulling conveying apparatus with the controller of the image forming apparatus has been described, but the sheet pulling conveying apparatus may include a controller and such controller may control the operation. Alternatively, the controller of the image forming apparatus may control the controller of the sheet pulling conveying apparatus to control the operation of the sheet pulling conveying apparatus. Similar effects can also be obtained with such configurations.

In the examples described above, the printer has been illustrated as the image forming apparatus, but the present invention is not limited thereto. For example, other image forming apparatuses such as a copying machine and a facsimile device, or other image forming apparatuses such as a multifunction peripheral combining the functions thereof may be adopted. The image forming apparatus that uses the intermediate transfer member to transfer the toner image of each color in a sequentially superimposed manner onto the intermediate transfer member, and collectively transfer the toner image borne on the intermediate transfer member onto the sheet has been described, but this is not the sole case. The image forming apparatus that uses a sheet bearing member to transfer the toner image of each color in a sequentially superimposed manner onto the sheet borne by the sheet bearing member may be adopted, and similar effects can be obtained by applying the present invention to the image forming apparatus or the sheet pulling conveying apparatus arranged in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-093705, filed Apr. 30, 2014, No. 2015-047165, filed Mar. 10, 2015, which are hereby incorporated by reference herein in their entirety.

What is claimed is:

1. A sheet conveying apparatus comprising:

a first pair of rotating members which conveys a sheet;

a second pair of rotating members which is provided downstream of the first pair of rotating members in a conveying direction of a sheet and which conveys a sheet; and a load portion configured to apply a load to a rotation of the first pair of rotating members so as to generate a tensile stress onto the sheet when the sheet is nipped by the first pair of rotating members and the second pair of rotating members; wherein the load portion includes, a rotary member rotated with one of the first pair of rotating members, a first slidably moving member which contacts with the rotary member from one axis direction of the rotary member, a second slidably moving member which contacts with the rotary member from the other axis direction of the rotary member, a first member which contacts with a first slidably moving member from one axis direction of the rotary member, the first member being able to move in the axis direction and regulated rotation, a second member which contact with a second slidably moving member from the other axis direction of the rotary member, and a force applying portion which applies force on the first member in the axial direction of the rotary member.

2. The sheet conveying apparatus according to claim 1, wherein the first slidably moving member is put on a projection disposed on one end face of the rotary member, the second slidably moving member is put on a projection disposed on the other end face of the rotary member, and the first slidably moving member slides between the rotary member and the first member and the second slidably moving member slides between the rotary member and the second member.

3. The sheet conveying apparatus according to claim 1, wherein the first slidably moving member is put on a hole disposed on the rotary member, the second slidably moving member is put on a hole disposed on the rotary member, and when the rotary member rotates, the first slidably moving member and the second slidably moving member rotate with the rotary member, and the first slidably moving member slides to the first member and the second slidably moving member slides to the second member.

4. The sheet conveying apparatus according to claim 1, the first slidably moving member and the second slidably moving member are fixed on the rotary member, and when the rotary member rotates, the first slidably moving member and the second slidably moving member rotate with the rotary member, and the first slidably moving member slides to the first member and the second slidably moving member slides to the second member.

5. The sheet conveying apparatus according to claim 1, wherein the first slidably moving member is fixed on the first member and the second slidably moving member is fixed on the second member, and when the rotary member rotates the rotary member slides to the first slidably moving member and the second slidably moving member.

6. The sheet conveying apparatus according to claim 1, wherein a slidably moving unit including the rotary member and the first slidably moving member and the second slidably moving member are arranged in plurals in the axial direction, and the fixing member is arranged between the adjacent slidably moving units.

7. The sheet conveying apparatus according to claim 1, further comprising a changing portion which changes the force applied by the force applying portion.

8. The sheet conveying apparatus according to claim 7, wherein the changing portion includes a motor which generates a driving force and a cam which rotates by the driving force of the motor.

9. The sheet conveying apparatus according to claim 7, further comprising:

an acquiring portion which acquires information associated with a conveying sheet; and a controller which controls the changing portion based on the information acquired by the acquiring portion to change the force applied by the force applying portion.

10. The sheet conveying apparatus according to claim 1, wherein a tensile stress is applied to a central region in the width direction of the sheet, the width direction being orthogonal to the conveying direction.

11. The sheet conveying apparatus according to claim 1, wherein a length of at least one of a first nip portion or a second nip portion is shorter than a length of a conveying sheet in the width direction orthogonal to the conveying direction of the sheet, the first nip portion being a nip formed by the first pair of rotating members and the second nip portion being a nip formed by the second pair of rotating members.

12. The sheet conveying apparatus according to claim 1, further comprising a humidifying portion which humidifies a sheet, the humidifying portion being arranged upstream in the sheet conveying direction of the first pair of rollers and the second pair of rollers.

13. The sheet conveying apparatus according to claim 1, wherein the rotary member is made from a metal.

14. The sheet conveying apparatus according to claim 1, wherein the first slidably moving member and the second slidably moving member are made from a heat resistant resin.

15. An image forming apparatus comprising:

a rotating member; and a load portion configured to apply a load on a rotation of the rotating member, wherein the load portion includes, a rotary member rotated with the rotating member, a first slidably moving member which contacts with the rotary member from one axis direction of the rotary member, a second slidably moving member which contacts with the rotary member from the other axis direction of the rotary member, a first member which contacts with a first slidably moving member from one axis direction of the rotary member, the first member being able to move in the axis direction and regulate rotation, a second member which contact with a second slidably moving member from the other axis direction of the rotary member, and a force applying portion which applies force to the first member in the axial direction of the rotary member.

16. The image forming apparatus according to claim 15, wherein the first slidably moving member is put on a projection disposed on one end face of the rotary member, the second slidably moving member is put on a projection disposed on the other end face of the rotary member, and the first slidably moving member slides between the rotary member and the first member and the second slidably moving member slides between the rotary member and the second member.

17. The image forming apparatus according to claim 15, wherein the first slidably moving member is put on a hole disposed on the rotary member, the second slidably moving member is put on a hole disposed on the rotary member, and when the rotary member rotates, the first slidably moving member and the second slidably moving member rotates with the rotary member, and the first slidably moving member slides to the first member and the second slidably moving member slides to the second member.

18. The image forming apparatus according to claim 15, wherein the first slidably moving member and the second slidably moving member is fixed on the rotary member, and when the rotary member rotates, the first slidably moving member and the second slidably moving member rotate with the rotary member, and the first slidably moving member slides to the first member and the second slidably moving member slides to the second member.

19. The image forming apparatus according to claim 15, wherein the first slidably moving member is fixed on the first member and the second slidably moving member is fixed on the second member, and when the rotary member rotates, the rotary member slides to the first slidably moving member and the second slidably moving member.

20. The image forming apparatus according to claim 15, further comprising a slidably moving unit including the rotary member, the first slidably moving member and the second slidably moving member, wherein the first slidably moving unit and the second slidably moving unit are arranged in plurals in the axial direction, and the fixing member is arranged between adjacent slidably moving units.

21. The image forming apparatus according to claim 15, further comprising a changing portion which changes the force applied by the force applying portion.

22. The image forming apparatus according to claim 21, wherein the changing portion includes a motor which generates a driving force and a cam which rotates by the driving force of the motor.

23. The image forming apparatus according to claim 21, further comprising:

an acquiring portion which acquires information associated with a conveying sheet; and a controller which controls the changing portion based on the information acquired by the acquiring portion to change the force applied by the force applying portion.

24. The image forming apparatus according to claim 15, wherein the rotating member is an image bearing member which bears an electrostatic latent image.

25. The image forming apparatus according to claim 15, further comprising:

a first pair of rotating members which conveys a sheet; and a second pair of rotating members which is arranged downstream of the first pair of rotating members in a conveying direction of the sheet, and which conveys the sheet; wherein the rotating member is the first pair of rotating members; and a tensile stress generates in the sheet when the sheet is nipped by the first pair of rotating members and the second pair of rotating members.

26. The image forming apparatus according to claim 15, wherein the rotary member is made from a metal.

27. The image forming apparatus according to claim 15, wherein the first slidably moving member and the second slidably moving member are made from a heat resistant resin.

28. An image forming apparatus comprising:

an image forming portion which forms a toner image on a sheet;

a fixing portion which fixes the sheet by heating the toner image on the sheet formed by the image forming portion; and a sheet conveying apparatus which conveys a sheet passed through the fixing portion; wherein the sheet conveying apparatus includes, a first pair of rotating members which conveys a sheet, a second pair of rotating members which is provided downstream of the first pair of rotating members in a conveying direction of a sheet and which conveys a sheet, and a load portion which is configured to apply a load to rotation of the first pair of rotating members so as to generate a tensile stress onto the sheet when the sheet is nipped by the first pair of rotating members and the second pair of rotating members, wherein the load portion includes, a rotary member rotated with the first rotating member, a first slidably moving member which contacts with the rotary member from one axis direction of the rotary member, a second slidably moving member which contacts with the rotary member from the other axis direction of the rotary member, a first member which contacts with a first slidably moving member from one axis direction of the rotary member, the first member being able to move in the axis direction and regulate rotation, a second member which contact with a second slidably moving member from the other axis direction of the rotary member, and a force applying portion which applies forces to the first member in the axial direction of the rotary member.

* * * * *